US007766450B2

(12) United States Patent
Nishizaki et al.

(10) Patent No.: US 7,766,450 B2
(45) Date of Patent: Aug. 3, 2010

(54) INK JET RECORDING APPARATUS

(75) Inventors: Masahiro Nishizaki, Iwakura (JP); Motohiro Momozaki, Nagoya (JP); Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 869 days.

(21) Appl. No.: 11/532,304

(22) Filed: Sep. 15, 2006

(65) Prior Publication Data

US 2007/0115318 A1 May 24, 2007

(30) Foreign Application Priority Data

Sep. 16, 2005 (JP) ..... 2005-269925
Sep. 16, 2005 (JP) ..... 2005-269926
Sep. 16, 2005 (JP) ..... 2005-269927

(51) Int. Cl.
*B41J 2/165* (2006.01)

(52) U.S. Cl. ..... 347/33; 347/29; 347/32

(58) Field of Classification Search ..... 347/29, 347/30, 32, 33, 23
See application file for complete search history.

(56) References Cited

U.S. PATENT DOCUMENTS 5,798,775 A * 8/1998 Takahashi et al. ..... 347/33

FOREIGN PATENT DOCUMENTS

| | | |
|---|---|---|
| JP | H7 101082 | 4/1995 |
| JP | H9 99558 | 4/1997 |
| JP | H9 118012 | 5/1997 |
| JP | H9 156116 | 6/1997 |
| JP | H10 202908 | 8/1998 |
| JP | H11 115191 | 4/1999 |
| JP | H11 342631 | 12/1999 |
| JP | 2000 203043 | 7/2000 |
| JP | 2001 219559 | 8/2001 |
| JP | 2001 219595 | 8/2001 |
| JP | 2001 287376 | 10/2001 |
| JP | 2001 287378 | 10/2001 |
| JP | 2002 96457 | 4/2002 |
| JP | 2002 331678 | 11/2002 |
| JP | 2004 148686 | 5/2004 |
| JP | 2005 81594 | 3/2005 |

* cited by examiner

*Primary Examiner*—Shih-Wen Hsieh
(74) *Attorney, Agent, or Firm*—Baker Botts L.L.P.

(57) ABSTRACT

An ink jet recording apparatus that includes: a recording head that discharges an ink from a plurality of nozzles constituting a nozzle train to a recording medium; a cap that covers a nozzle surface of the recording head with a hollow cap member; and a wiper that wipes the nozzle surface of the recording head with a wiper member by a relative movement of the wiper member with respect to the recording head, wherein at least one of the wiper member and the nozzle surface comprises a removing portion that removes a foreign matter from the nozzle surface.

26 Claims, 18 Drawing Sheets

INK JET RECORDING APPARATUS

CROSS REFERENCE TO RELATED APPLICATION

This application claims priority from Japanese Patent Applications No. 2005-269925, 2005-269926 and 2005-269927, filed on Sep. 16, 2005, the entire subject matters of which are incorporated herein by reference.

TECHNICAL FIELD

Aspects of the present invention relate to an ink jet recording apparatus.

BACKGROUND

Conventionally, there has been known an ink jet recording apparatus which relatively moves a recording sheet (recording medium) with respect to a recording head and discharges an ink droplet to the recording sheet while moving the recording head in a transverse direction of the recording sheet over a carriage, thereby carrying out a recording operation.

Such a recording head discharges the ink droplet from the nozzle to the recording sheet, thereby carrying out the recording operation. Therefore, there is a possibility that an opening of the nozzle might be clogged to cause a recording failure due to a rise in a viscosity of an ink which is caused by an evaporation of the ink from the opening of the nozzle, a solidification of the ink, an adhesion of dust, and furthermore, a mixture of bubbles.

For this reason, the ink jet recording apparatus generally comprises a cap means for covering a nozzle surface of a recording head with a cap member in a non-recording operation and wiper means for cleaning the nozzle surface of the recording head by means of a wiper member if necessary.

A normal ink jet recording apparatus carries out an operation for sucking an ink in a nozzle in a state in which the nozzle surface is covered with the cap member and then wiping the nozzle surface by means of the wiper member, thereby removing the residual ink.

More specifically, the wiper means serves to sweep away the ink remaining on the nozzle surface and has been used to eliminate a drawback that the ink remaining on the nozzle surface is dried to clog the nozzle.

There has been proposed an ink jet recording apparatus for effectively collecting an ink swept away by a wiper member and preventing a contamination caused by an ink waste liquid dropped from the wiper member and the generation of a driving failure of an apparatus (for example, see JP-A-2005-81594 (paragraphs 0033 to 0037 and FIGS. 7 and 8).

SUMMARY

According to an aspect of the invention, there is provided an ink jet recording apparatus comprising: a recording head that discharges an ink from a plurality of nozzles constituting a nozzle train to a recording medium; a cap that covers a nozzle surface of the recording head with a hollow cap member; and a wiper that wipes the nozzle surface of the recording head with a wiper member by a relative movement of the wiper member with respect to the recording head, wherein at least one of the wiper member and the nozzle surface comprises a removing portion that removes a foreign matter from the nozzle surface.

DETAILED DESCRIPTION

[General Overview]

Figure 1:
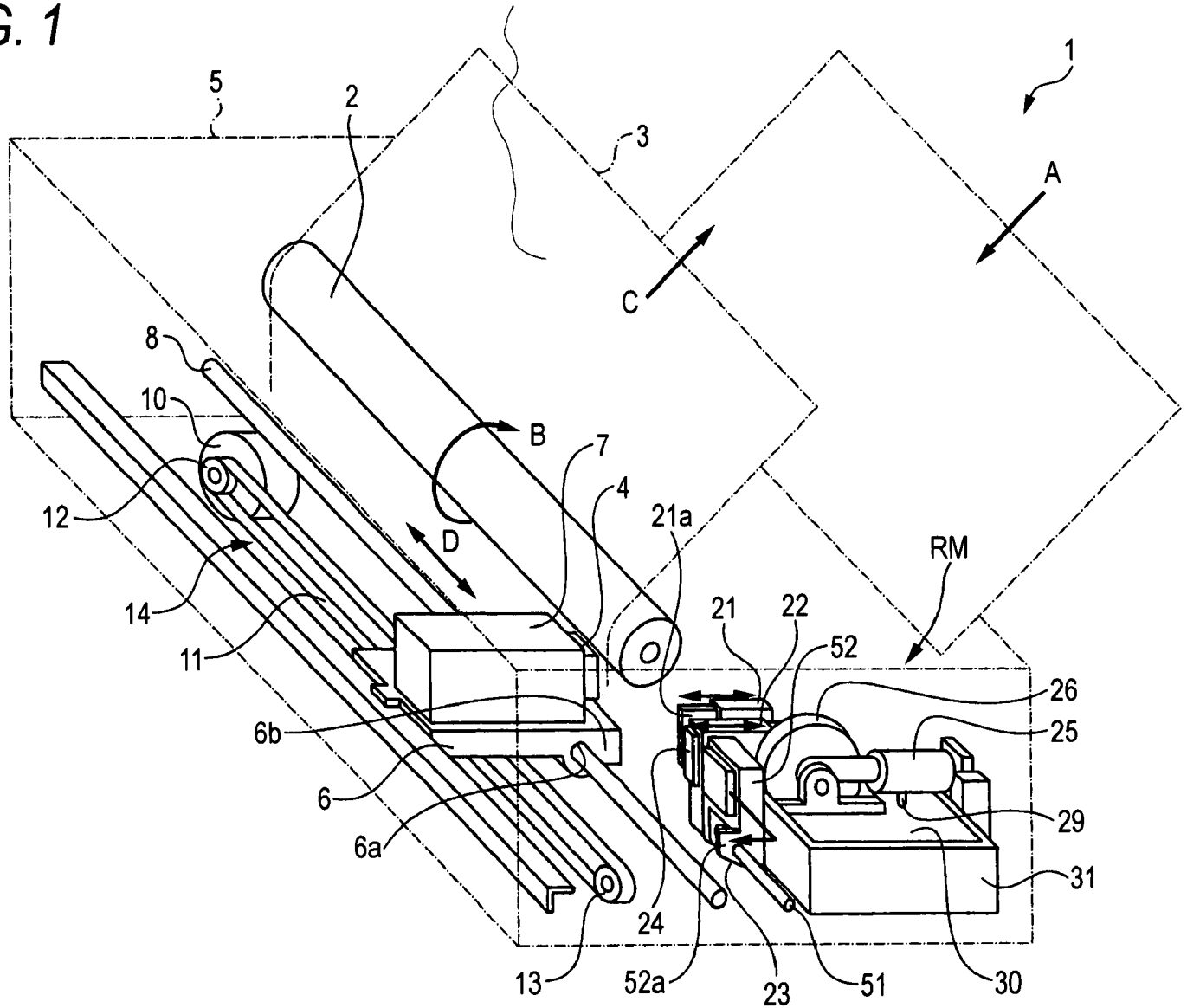
FIG. 1 is a perspective view showing a schematic structure of an ink jet recording apparatus according to an aspect of the invention.
Figure 2:
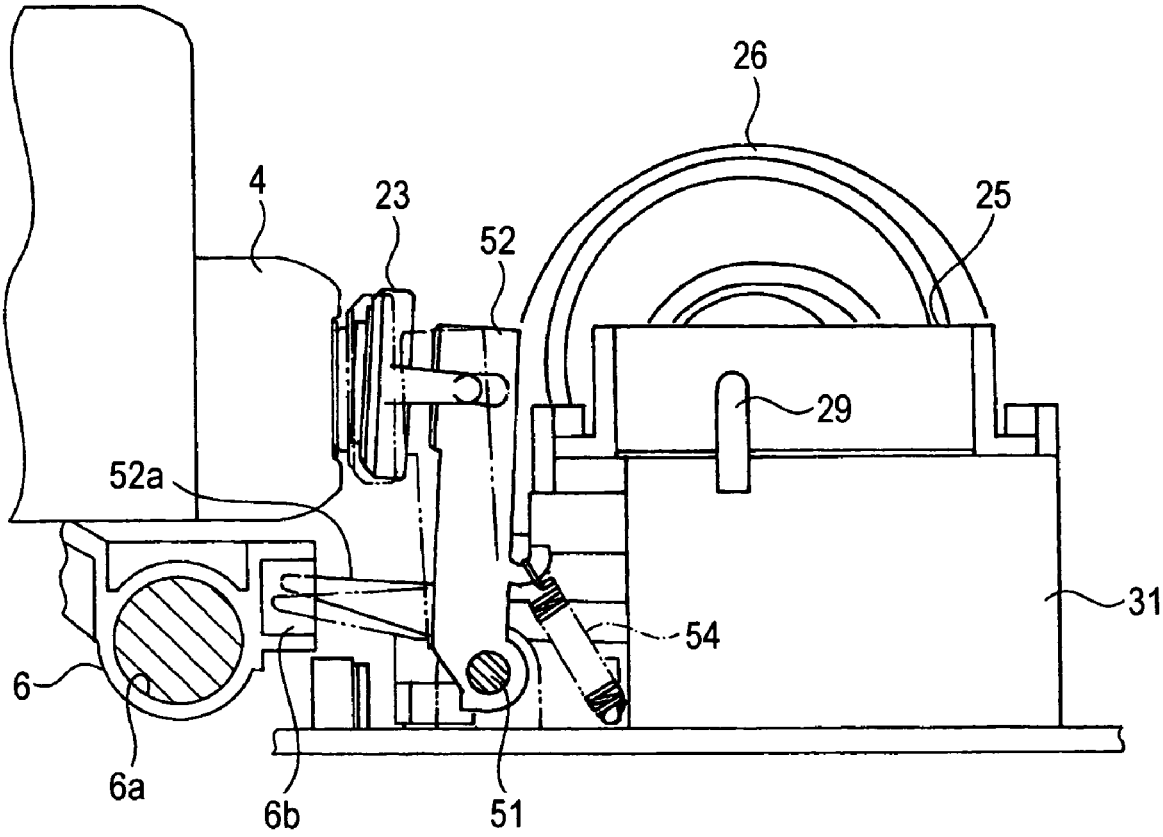
FIG. 2 is a side view showing the vicinity of a recovering unit in the recording apparatus.

The cap for covering the nozzle surface is formed by a rubber material. However, it has been found by the studies of the inventor that a substance deposited by a contact of the rubber material with the ink has a bad influence on the ink jet recording apparatus in some cases.

In other words, according to the knowledge of the inventors, the material is easily changed chemically due to a contact with the ink in a portion which comes in direct or indirect contact with the ink to be used for ink recording and it is necessary to select the material very carefully. In particular, when the rubber material comes in contact with an ink jet ink for a predetermined period of time, a vulcanizer and other reactive assistants which are added in a process for manufacturing a rubber are deposited or accumulated on the nozzle surface. For this reason, there is a possibility that a rubber characteristic might be damaged, recording quality might be deteriorated by an influence of the physical properties of the ink, and furthermore, a whole operation of the ink jet apparatus might be disturbed remarkably.

More specifically, the rubber material is often used in the cap means for covering the nozzle surface of the recording head with the cap member and the wiper means for sweeping away the ink droplet on the nozzle surface by the wiper member. For this reason, there is a possibility that a foreign matter (for example, a deposited substance) generated on the cap member or the wiper member might enter the nozzle or might stick to an outer periphery by the wiping operation of the wiper member, resulting in a great influence on an ink discharging stability. In the case in which a contact portion with the cap member and the opening of the nozzle are constituted by the same plane, particularly, there is a possibility that a foreign matter such as a deposited substance generated in the contact portion with the cap member or an ink mist might enter the nozzle to cause an ink discharging failure or to deteriorate a straightness of the discharge of the ink droplet in the case in which the contact portion with the cap member and the opening of the nozzle are constituted by the same plane.

Since the conventional wiper means serves to wipe the nozzle surface including the discharging port of the nozzle, however, there is a possibility that the foreign matter might be pushed into the nozzle and the wiper means is not suitable for solving the problems. Moreover, the wiper member disclosed in JP-A-2005-81594 does not serve to wipe the contact portion with the cap on the nozzle surface. Therefore, there is a small possibility that the foreign matter might be pushed into the nozzle by means of the wiper member. However, the foreign matter is maintained to remain on the nozzle surface. For this reason, there is a danger that the foreign matter might enter the nozzle.

Aspects of the invention provide an ink jet recording apparatus capable of avoiding the clogging of an opening of a nozzle by a foreign matter such as a deposited substance generated in a contact portion of a cap member and a nozzle surface of a recording head, thereby maintaining a stable ink discharging characteristic for a long period of time.

A first aspect of the invention is directed to an ink jet recording apparatus comprising: a recording head that discharges an ink from a plurality of nozzles constituting a nozzle train to a recording medium; a cap that covers a nozzle surface of the recording head with a hollow cap member; and a wiper that wipes the nozzle surface of the recording head with a wiper member by a relative movement of the wiper member with respect to the recording head, wherein the wiper member includes a first portion that guides a foreign matter swept away by the wiper member to an outside of a nozzle region provided with the nozzle train during at least the relative movement of the wiper member.

Thus, the foreign matter swept away by the wiper member (for example, a deposited substance generated on the nozzle surface by a contact with the cap member or an ink mist) is guided to the outside of the nozzle region during at least the relative movement (a wiping operation) of the wiper member by the first portion of the wiper member. Accordingly, the foreign matter swept away by the wiper member is guided in a different direction from the nozzle region by means of the wiper member. Consequently, the invasion of the foreign matter into the nozzle (more specifically, the opening of the nozzle) can be avoided.

Thus, the shape of the wiper member is devised to guide the foreign matter generated in the contact portion of a peripheral edge portion of an opening of the cap member and the nozzle surface (for example, the deposited substance or the ink mist) is guided to a side provided apart from the nozzle region in the wiping operation of the wiper member. Therefore, it is possible to stably maintain a constant ink discharging characteristic for a long period of time.

A second aspect of the invention is directed to the ink jet recording apparatus, wherein the first portion is formed corresponding to a first region extended orthogonal to a direction of extension of the nozzle train in a contact region with a peripheral edge portion of an opening of the cap member in the nozzle surface of the recording head.

Consequently, the first portion of the wiper member is formed corresponding to the first region extended orthogonal to a direction of extension of the nozzle train in the contact region with the peripheral edge portion of the opening of the cap member in the nozzle surface of the recording head. Therefore, the foreign matter generated around the first region including the deposited substance generated in the first region of the nozzle surface by the contact with the cap member is reliably guided to the outside of the nozzle region. Accordingly, the invasion of the foreign matter into the nozzle can be avoided.

A third aspect of the invention is directed to the ink jet recording apparatus, wherein the first portion is formed with a rearward inclination or curve by a friction with the nozzle surface with respect to a direction of the movement of the wiper member during the relative movement of the wiper member. Here, "is formed with a curve" implies that the first portion is not formed linearly. A shape is not particularly restricted if it can guide a foreign matter swept away by the wiper member in a different direction from the nozzle region.

Thus, a part of the wiper member (a portion corresponding to the first region) is deformed by a frictional force generated in a portion between the wiper member and the nozzle surface during the wiping operation of the wiper member so that the portion for guiding the foreign matter to the outside of the nozzle region, that is, the first portion is formed. Even if the first portion is not previously formed as a part of the wiper member, accordingly, it is formed when the foreign matter is to be actually guided to the outside of the nozzle region by utilizing the friction with the nozzle surface.

A fourth aspect of the invention is directed to the ink jet recording apparatus, wherein the first portion is previously formed with a rearward inclination or curve with respect to a direction of the movement of the wiper member.

Consequently, the first portion for guiding the foreign matter to the outside of the nozzle region can be previously formed as a part of the wiper member.

A fifth aspect of the invention is directed to the ink jet recording apparatus, wherein the first portion is linked to both ends of a second portion that wipes the nozzle region.

Thus, the nozzle region is wiped by the second portion of the wiper member so that the residual ink is removed and the foreign matter is guided to the outside of the nozzle region by the first portion of the wiper member.

A sixth aspect of the invention is directed to the ink jet recording apparatus, wherein a wiping operation of the second portion in the wiper member is performed in such a manner that a portion between a second region extended in a direction of extension of the nozzle train and the nozzle region in a contact region with a peripheral edge portion of an opening of the cap member in the nozzle surface of the recording head is set to be a wiping start position and the second portion in the wiper member starts the wiping operation toward the nozzle region from the wiping start position.

Consequently, the portion between the second region which is extended in the direction of extension of the nozzle train and the nozzle region in the contact region with the peripheral edge portion of the opening of the cap member in the nozzle surface of the recording head is set to be the wiping start position and the wiping operation is started by the wiper member from the wiping start position toward the nozzle region. Therefore, the second region which is extended in the direction of the nozzle train can be prevented from being wiped by the wiper member. Accordingly, it is possible to avoid the invasion of the foreign matter present in the second region into the nozzle by the wiper operation.

A seventh aspect of the invention is directed to the ink jet recording apparatus according, wherein a wiping operation of the second portion in the wiper member is performed in such a manner that one of regions between the nozzles or the nozzle trains is set to be a wiping start position and the second portion in the wiper member carries out the wiping operation beyond one of ends of the nozzle region after the wiping operation is started, and then changes a direction of the wiping and carries out the wiping operation beyond the other end of the nozzle region.

Thus, the foreign matter (for example, the deposited substance of a rubber material) which is present in the second region is not invaded into the nozzle region but is swept away by the wiping operation of the wiper member (the second portion).

An eighth aspect of the invention is directed to the ink jet recording apparatus, wherein a plurality of nozzle trains is disposed on the nozzle surface of the recording head, and the wiper includes first and second wiper members supported movably, and the first and second wiper members are configured such that one of regions between the nozzle trains is set to be a wiping start position and they are moved in opposite directions to each other.

Thus, one of the two wiper members wipes a part of the nozzle surface including the nozzle region and the other wiper member wipes the residual portion of the nozzle surface. Consequently, it is possible to wipe the whole nozzle region in a short time.

A ninth aspect of the invention is directed to the ink jet recording apparatus, wherein the wiper member has two plate-shaped portions taking a dogleg-shaped section and serving as the first portion, the two plate-shaped portions are rearward inclined with respect to a direction of the movement of the wiper member.

With a simple structure, consequently, the foreign matter swept away by the wiper member is guided to the outside of the nozzle region by the plate-shaped portion to be the first portion.

A tenth aspect of the invention is directed to the ink jet recording apparatus, wherein a trap portion capable of trapping a foreign matter swept away by the wiper member is provided on an outside of a contact position of the cap member and the nozzle surface. The trap portion may be a member having a space for trapping and storing a foreign matter including an ink, for example, a concave portion, may be a member for absorbing an ink, for example, a felt material, and may be a member, for example, a concave portion filled with a felt material.

Thus, the foreign matter (including the ink) swept away by the wiper member is trapped into the trap portion so that a bad influence on the other portions can be avoided during the wiping operation.

An eleventh aspect of the invention is directed to the ink jet recording apparatus, wherein a hinge that permits the second portion to be inclined at a certain angle with respect to the first portion corresponding to a direction of the relative movement of the wiper member with respect to the recording head is provided in a linking portion of the first portion and the second portion. The hinge may be formed by a separate material from a rubber material constituting the wiper member and a thin hinge utilizing the rubber material can also be used.

Thus, the direction of the first portion with respect to the second portion is changed corresponding to the direction of the relative movement of the wiper member so that a bidirectionality can be maintained. In other words, also in the case in which the wiper member is moved in any direction, the function of guiding the foreign matter swept away to the outside of the nozzle region can be exhibited.

The structure described above is employed. Therefore, the foreign matter swept away by the wiper member (for example, the deposited substance generated on the nozzle surface by the contact with the cap member or the ink mist) is guided to the outside of the nozzle region provided with the nozzle during at least the relative movement of the wiper member by means of the first portion of the wiper member. Therefore, it is possible to avoid the invasion of the foreign matter swept away by the wiper member into the nozzle. Accordingly, it is possible to stably maintain a constant ink discharging characteristic for a long period of time.

An aspect according to the invention will be described below with reference to the drawings.

In FIG. 1 showing an outer appearance of an ink jet printer, an ink jet printer 1 has a cylindrical platen roller 2. The platen roller 2 serves to deliver a recording sheet 3 (a recording medium) fed from a sheet feed cassette or a manual sheet feeding portion while facing a recording head 4, and is rotatably supported on a frame 5 by means of a rotating shaft (not shown) extended in a transverse direction. The recording head 4 discharges an ink from a plurality of nozzles constituting a nozzle train to the recording sheet 3 so that a printing operation is carried out. The recording sheet 3 is constituted to be fed from a sheet feeding port (not shown) provided behind the frame 5 in a direction of an arrow A, to be fed in a direction of an arrow B by the rotation of the platen roller 2 and to be discharged in a direction of an arrow C from a sheet discharging port which is not shown.

A carriage 6 is provided in front of the platen roller 2 so as to be movable in a D direction along an axis of the platen roller 2. The carriage 6 removably mounts the recording head 4 of an ink jet type and an ink cartridge 7 for accommodating an ink to be fed to the recording head 4, respectively. Moreover, the carriage 6 has a fitting hole portion **6*a* to slidably fit a carriage shaft 8 provided in parallel with the axis of the platen roller 2. Consequently, the recording head 4 mounted on the carriage 6 can be reciprocated by a sliding movement along the axis of the platen roller 2. As a carriage motor 10 for moving the carriage 6, for example, a step motor or a DC motor is used, and there is employed a structure in which the carriage 6 is moved through a belt mechanism 14 having a belt 11 and pulleys 12 and 13**.

Moreover, a recovering device RM for recovering a non-discharge or a discharging failure of the recording head 4 is provided on a right side of the platen roller 2. The reason why the recovering device RM is provided is that a discharging failure is caused by the generation of bubbles in an inner part during use or the adhesion of an ink droplet onto a discharging surface because of the recording head 4 of the ink jet type and an excellent discharging state is to be therefore recovered.

For the recovering device RM, there are provided a wiper device 21 (wiper) for wiping a nozzle surface of the recording head 4, a purge device 22 (cap) for sucking a defective ink in the recording head 4 and a protecting cap device 23 for covering the nozzle surface of the recording head 4 to prevent the evaporation of the ink.

The wiper device 21 has a plate-shaped wiper member 21*a* which is provided to be forward and backward movable between a standby position and an operating position and serves to wipe the nozzle surface in contact with the nozzle surface of the recording head 4 in an operating position. The wiper member 21*a* is placed in a backward moving position in a printing operation.

The purge device 22 includes a hollow sucking cap member 24 which is provided to be forward and backward movable between a standby position and an operating position and serves to cover the nozzle surface of the recording head 4 in contact with the nozzle surface in the operating position. A negative pressure is generated in the sucking cap member 24 by means of a sucking pump 25 in a state in which the nozzle surface of the recording head 4 is covered with the sucking cap member 24 in the operating position and a defective ink in the recording head 4 is sucked to recover an excellent discharging state. The sucking cap member 24 is placed in a backward moving position in the printing operation.

The sucking cap member 24 is connected to the sucking pump 25 through a sucking tube (not shown). Moreover, one of ends of a discharging tube 29 having the other end connected to the sucking pump 25 is connected to a waste ink tank 31 in which an adsorbent 30 is accommodated. Accordingly, the defective ink in the nozzle of the recording head 4 which is sucked through the sucking tube by means of the sucking pump 25 is discharged to the waste tank ink 31 through the discharging tube 29 and is adsorbed into the absorber 30 in the waste ink tank 31.

The forward and backward movements of the wiper member 21*a* of the wiper device 21, the forward and backward movements of the sucking cap member 24 of the purge device 22 and a driving operation of the sucking pump 25 (the forward and backward movements of a piston member) are controlled by rotating and driving a pump cam gear 26. In other words, the wiper member 21*a* is controlled through a wiper driving member having a rear end engaged with a first cam groove of the pump cam gear 26, and furthermore, the sucking cap member 24 of the purge device 22 is controlled by an engagement of a rear end with a second cam groove and the sucking pump 25 is controlled by an engagement of rear ends of a pair of pistons thereof (not shown) with third and fourth cam grooves. By such a control, a series of recovering operations are carried out. In the aspect, the driving operation of the pump cam gear 26 (the forward and backward movements of the wiper member 21*a* of the wiper device 21, the forward and backward movements of the sucking cam member 24 of the purge device 22 and the driving operation of the sucking pump 25) is carried out through a coupling for removably coupling a driving unit such as a driving motor of a sheet feeding device by the driving unit. However, it is apparent that special driving unit can also be provided and the forward and backward movements of the wiper member. 21*a* of the wiper device 21, the forward and backward movements of the sucking cap member 24 of the purge device 22 and the driving operation of the sucking pump 25 can also be carried out by using a driving mechanism other than a driving mechanism utilizing the pump cam gear.

Moreover, a guide rod member 51 is provided in the waste ink tank 31 in parallel with a direction of the movement of the carriage 6, and a movable support member 52 for supporting the protecting cap device 23 is supported on the guide rod member 51 slidably and rotatably. The movable support member 52 has an engaging projection 52*a* to be engaged removably with an engaged portion 6*b* formed on the carriage 6. When the engaging projection 52*a* is engaged with the engaged portion 6*b* of the carriage 6, consequently, it is slid in accordance with the movement of the carriage 6. In the sliding movement, the movable support member 52 is rotated toward the recording head 4 side to cover the nozzle surface of the recording head 4 with the protecting cap device 23 in an engagement relationship between a guide convex portion (not shown) of the movable support member 52 and a guide slant face of a guide member (not shown).

Moreover, a coil spring 54 is provided between the movable support member 52 and the waste ink tank 31, and the movable support member 52 is returned to a standby state and the protecting cap device 23 is always energized in such a direction as to go away from the recording head 4.

Subsequently, the shape of the wiper member 21*a* of the wiper device will further be described.

Figure 3:
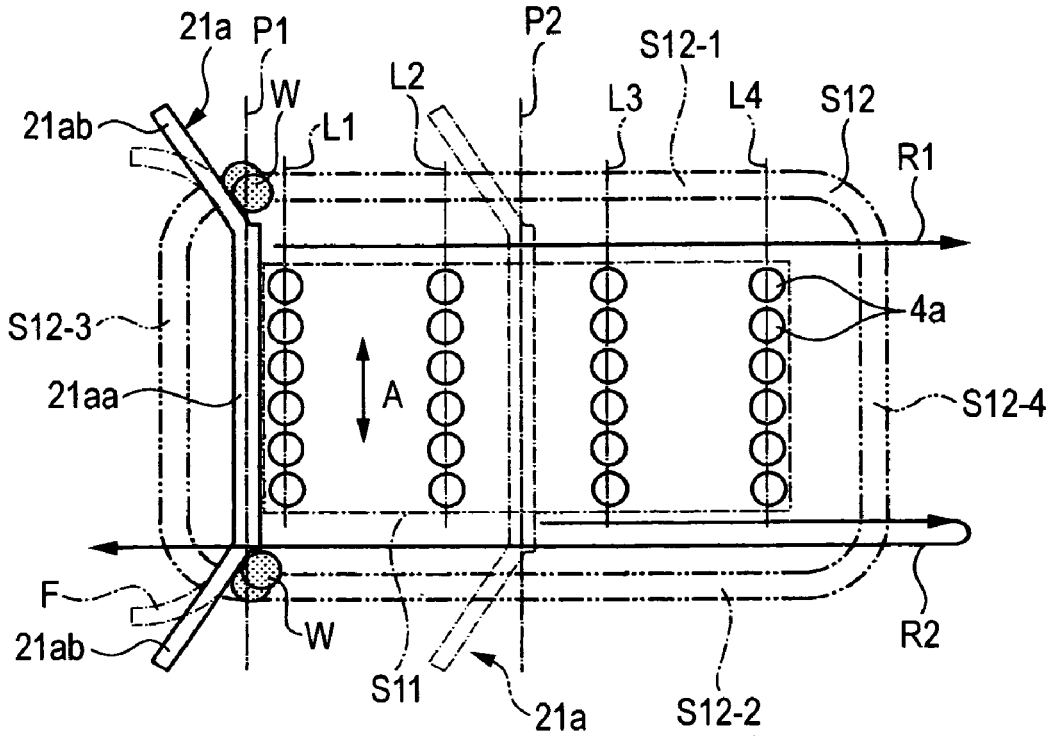
FIG. 3 is an explanatory view showing a relationship between a nozzle surface of a recording head and a wiper member.

First of all, a nozzle region S11 provided with a nozzle 4*a* and a peripheral portion thereof are wiped by the wiper member 21*a* as shown in FIG. 3. In the aspect, four nozzle trains L1 to L4 are formed in the nozzle region S11. In each of the nozzle trains L1 to L4, a plurality of nozzles is disposed in an orthogonal direction to a wiping direction of the wiper member 21*a*. The nozzle region S11 in the nozzle surface of the recording head 4 has such a structure as to be covered with the sucking cap member 24 in the purge operation. Over the nozzle surface, accordingly, a rectangular ring-shaped contact region S12 with the peripheral edge portion of the opening of the sucking cap member 24 is disposed around the nozzle region S11. The contact region S12 takes a shape corresponding to the peripheral edge portion of the opening of the cap member 24 and has two straight first regions S12-1 and S12-2 extended in the direction perpendicular to an extension of the nozzle trains L1 to L4 and two straight second regions S12-3 and S12-4 extended in parallel with the direction of the nozzle trains L1 to L4. The first regions S12-1 and S12-2 and the second regions S12-3 and S12-4 are smoothly connected respectively through curved regions.

As shown in FIG. 3, the wiper member 21*a* has a plate-shaped wiper base portion 21*aa* (a second portion) extended in parallel with the nozzle trains L1 to L4 and serving to wipe the whole nozzle region S11 and two wiper side portions 21*ab* and 21*ab* linked to both ends of the wiper base portion 21*aa* in an inclination state and having free ends extended to the outside of the nozzle region S11. The wiper side portions 21*ab* and 21*ab* are disposed corresponding to the first regions S12-1 and S12-2 in the contact region S12 and serve to wipe the first regions S12-1 and S12-2. The wiper side portions 21*ab* and 21*ab* are inclined to the wiper base portion 21*aa*, and therefore, exhibit the function of guiding a foreign matter W swept away to the outside of the nozzle region S11 (that is, the outside of the first regions S12-2 and S12-2) during the wiping operation.

When the recording head 4 is moved by means of the carriage 6, the wiper member 21*a* is moved forward by the rotation of the pump cam gear 26 so that the wiper base portion 21*aa* of the wiper member 21*a* comes in contact with a portion between the second region S12-3 (or the region S12-4) in the contact region S12 over the nozzle surface of the recording head 4 and the nozzle region S11 set to be a wiping start position (for example, a position P1). After the contact, the movement of the recording head 4 is continuously carried out. Therefore, the wiper base portion 21*aa* is relatively operated from the wiping start position P1 toward a side on which the nozzle 4*a* is provided (that is, the nozzle region S11 side) so that the wiping operation is started and is ended beyond the other second region S12-4 (or the region S12-3).

Thus, the foreign matter (the deposited substance generated on the nozzle surface by the contact with the sucking cap member 24 or the ink mist) swept away by the wiper member 21*a* (particularly, the wiper side portions 21*ab* and 21*ab*) does not enter the nozzle region S11 but is smoothly guided to the outside of the nozzle region S11 with the relative movement of the wiper member 21*a* through the inclination of the wiper side portions 21*ab* and 21*ab* during at least the relative movement of the wiper member 21*a*. In other words, a direction of a movement (a direction of discharge) of the foreign matter swept away by the wiper member 21*a* is different from the nozzle region S11. Therefore, the foreign matter does not enter the nozzle 4*a* so that the generation of clogging of the nozzle can be avoided. Accordingly, it is possible to maintain a constant ink discharging characteristic for stably discharging the ink for a long period of time.

While the aspect according to the invention has been described above, the invention is not restricted thereto but various changes can be made as will be described below.

(i) In the aspect, the recording head 4 (the carriage 6) is moved with respect to the wiper member 21*a* (of the wiper device) to be moved forward and backward between the standby position and the operating position (the wiping position), thereby wiping the nozzle surface. To the contrary, for example, it is also possible to employ a structure in which the wiper member is moved for the nozzle surface by using well-known driving unit with respect to the recording head set in a stopping state, thereby wiping the nozzle surface. For instance, it is also possible to employ a structure in which a wiper device including an actuator for moving the wiper member forward and backward is fixed onto a moving table and the moving table is moved along a guide rail to wipe the nozzle surface in a state in which the wiper member is placed in the operating position. In this case, the direction of a movement of the wiper member is not particularly restricted if a problem related to a layout can be eliminated, and may be a horizontal direction or a vertical direction (more specifically, may be a direction of the nozzle train or an orthogonal direction to the direction of the nozzle train).

(ii) The wiping operation of the wiper member 21*a* is not restricted to the foregoing but one of the regions between the nozzle trains L1 to L4 (between the nozzles in the case in which one nozzle train is provided) may be set to be a wiping start position P2 of the wiper base portion 21*aa* (see a one-dotted chain line in FIG. 3), and the wiping operation may be first carried out beyond one of ends of the nozzle region S11 (the second region S12-4) and the wiping direction may be then changed to perform the wiping operation beyond the other end of the nozzle region S11 (the second region S12-3) as shown in a route R2 of FIG. 3. Thus, it is possible to wipe the nozzle surface without bringing the deposited substance in the second regions S12-3 and S12-4 into the nozzle region S11 side.

Figure 4:
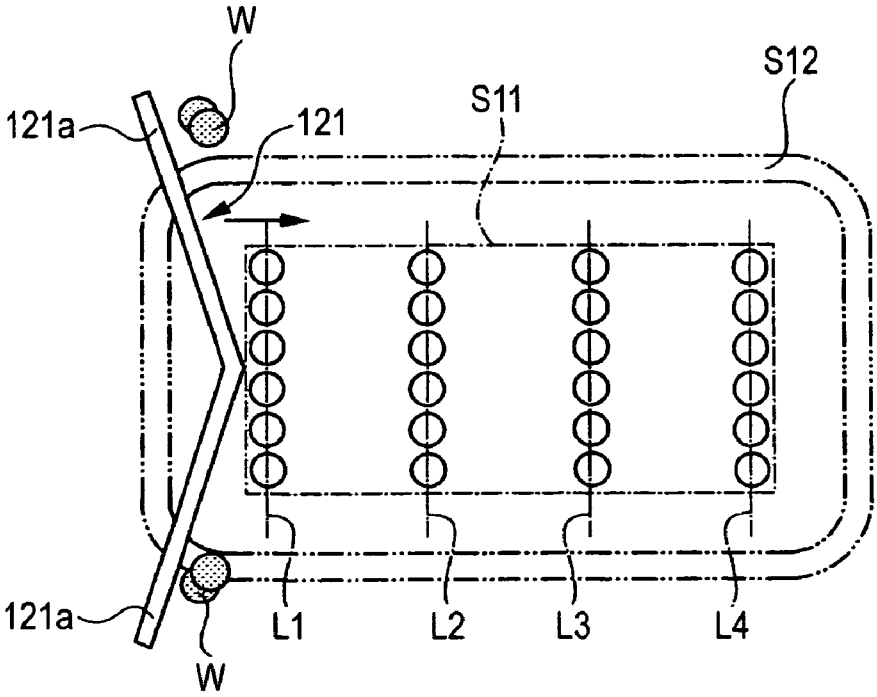
FIG. 4 is the same view as FIG. 3, illustrating another aspect.

(iii) While the wiper member 21*a* has such a structure that the two first portions are linked to both ends of the second portion in the aspect, foreign matter guide portions in a plurality of stages (including the first portion) may be provided on both ends of the second portion, that is, a third portion for guiding the foreign matter to the outside of the nozzle region is further provided on an outer end of the first portion, and furthermore, the wiper member can also be constituted with a substantial omission of the second portion as shown in FIG. 4, for example. In this case, a wiper member 121 has such a structure as to include two plate-shaped portions 121*a* bonded to make an acute angle in a direction of execution of the wiping operation and has a dogleg-shaped section. In other words, the two plate-shaped portions 121*a* form the first portion and a central linking part in the first portion also serves as the second portion in the aspect. However, the second portion is not substantially present.

Figure 5:
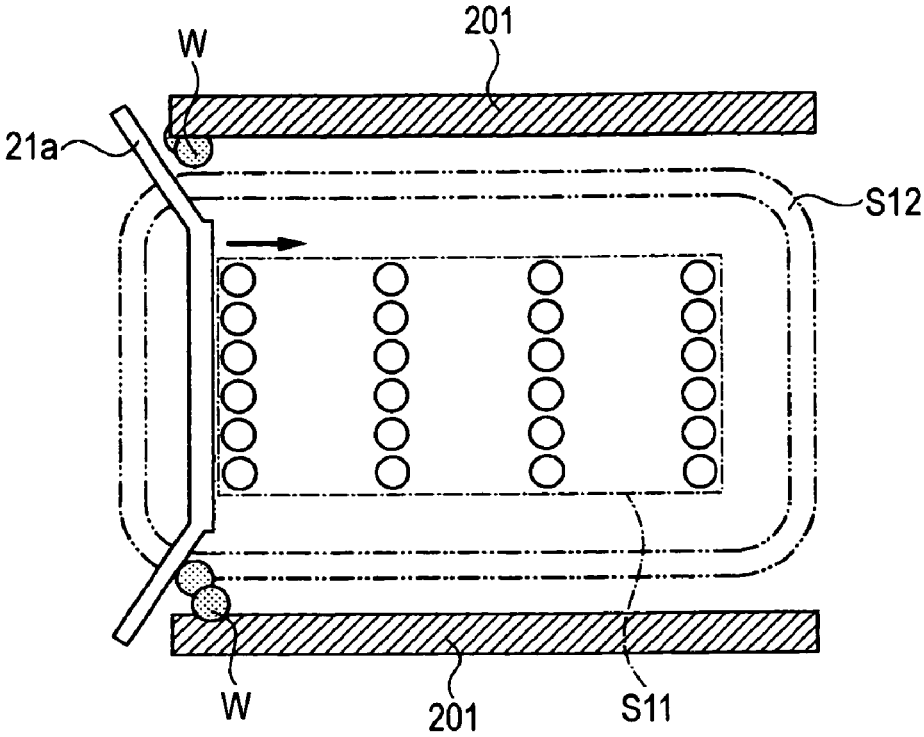
FIG. 5 is the same view as FIG. 3, illustrating a further aspect.

(iv) While the wiper member 21*a* is caused to simply carry out the wiping operation in the aspect, it is also possible to dispose a trap portion 201 capable of trapping the foreign matter swept away by the wiper member 21*a* as shown in FIG. 5 on the outside of the contact region (the second region S12) of the cap member 24 with the nozzle surface. The trap portion 201 may be constituted as a concave portion capable of storing the foreign matter, and furthermore, may be provided with an ink absorbing material such as a felt material and the ink absorbing material may be provided in the concave portion.

Figure 6:
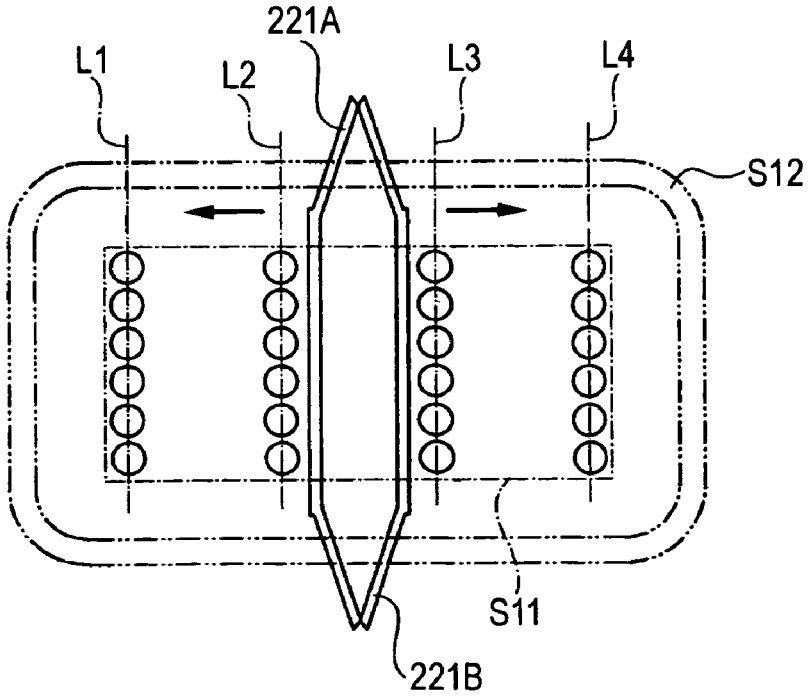
FIG. 6 is the same view as FIG. 3, illustrating a further aspect.

(v) Although the wiper device 21 has one wiper member 21*a* in the aspect, it is also possible to employ a structure in which two wiper members are provided. For example, as shown in FIG. 6, it is possible to employ a structure in which a plurality of nozzle trains L1 to L4 is disposed on the nozzle surface of the recording head, while the wiper includes first and second wiper members 221A and 221B supported movably, and one of regions between the nozzle trains L1 to L4 is set to be a wiping start position and the first and second wiper members 221A and 221B are moved in opposite directions to each other after the start of the wiping operation. In this case, there is employed a structure in which driving unit is provided for each of the two wiper members 221A and 221B and the wiper members 221A and 221B independently carry out the wiping operation.

Figure 7:
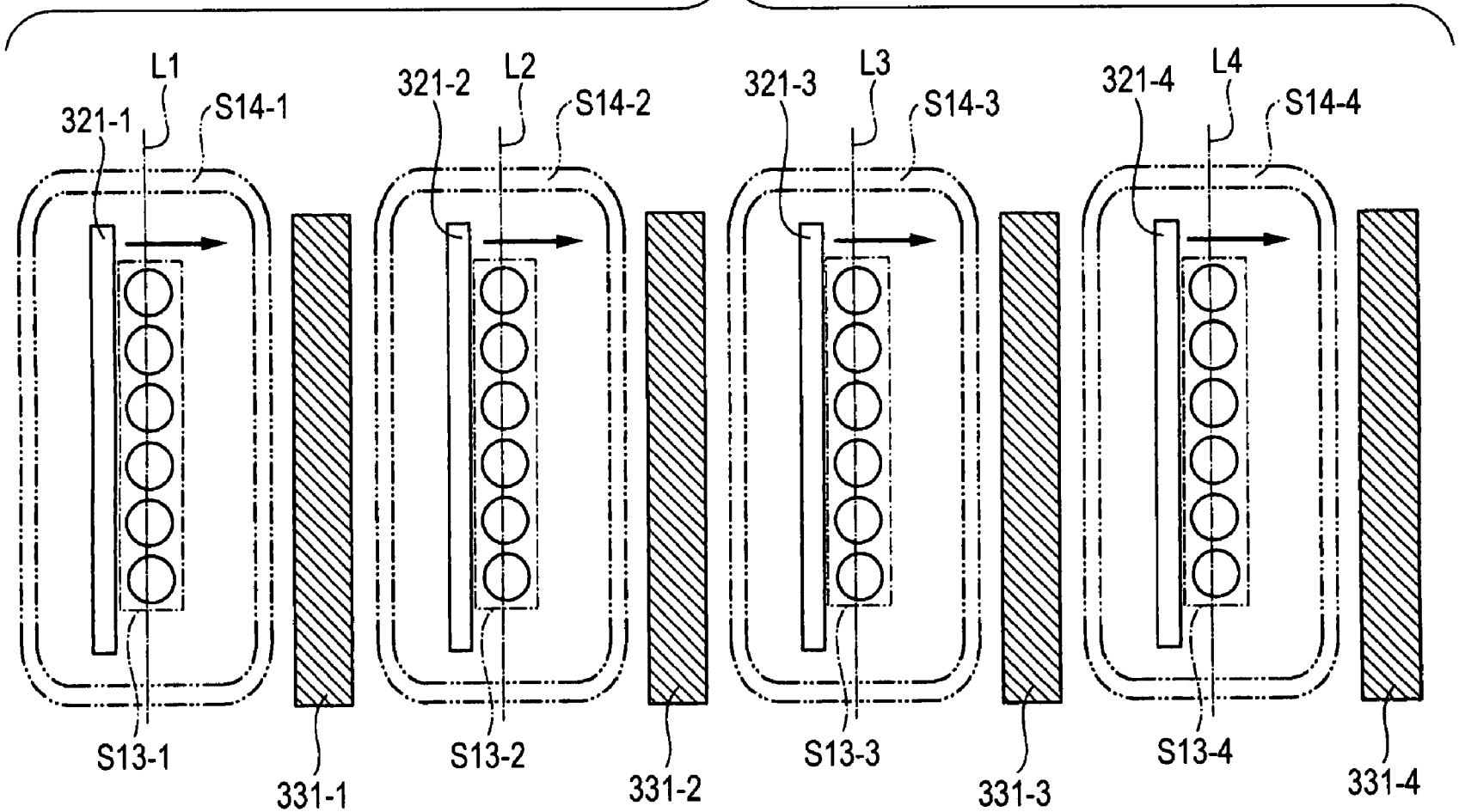
FIG. 7 is the same view as FIG. 3, illustrating a further aspect.

(vi) While the purge device 22 has one sucking cap member 24 in the aspect, the invention can also be applied to the case in which the sucking cap member has a plurality of cap portions and each of the cap portions carries out a covering operation for each nozzle train. In this case, as shown in FIG. 7, contact regions S14-1 to S14-4 with which the peripheral edge portion of the opening of each cap portion comes in contact are formed for each nozzle train around nozzle regions S13-1 to S13-4 having the nozzle trains L1 to L4. In a state in which the nozzle surface of the recording head is stopped, therefore, wiper members 321-1 to 321-4 may be provided for the four nozzle regions S13-1 to S13-4 and may be relatively moved with respect to the nozzle regions to wipe the nozzle regions. Also in this case, trap portions 331-1 to 331-4 may be provided in the same manner as in the case shown in FIG. 5.

(vii) While the wiper member 21 has such a shape that the wiper side portion 21*ab* (the first portion) is inclined rearward with respect to the direction of the movement of the wiper member 21*a* for the wiper base portion 21*aa* in the aspect, the invention is not restricted thereto but it is also possible to take such a shape as to be curved rearward with respect to the direction of the movement of the wiper member (see a one-dotted chain line F in FIG. 3).

Moreover, the wiper side portion does not need to be previously formed with respect to the wiper base portion but may have a structure in which the wiper side portion takes such a shape as to be inclined or curved rearward in the direction of the movement of the wiper member with respect to the wiper base portion by a friction with the nozzle surface during the relative movement of the wiper member.

Figure 8A:
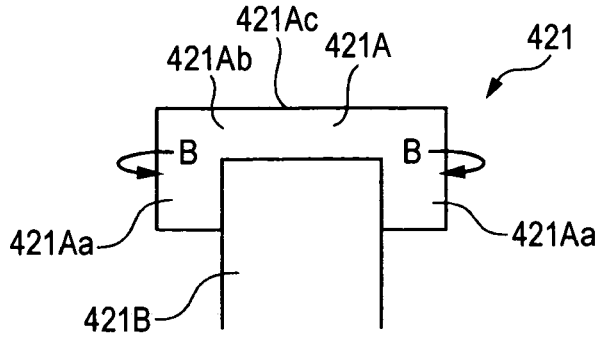
FIGS. 8A to 8D are explanatory views showing a relationship between a support portion of the wiper member and the wiper member, respectively.
Figure 8B:
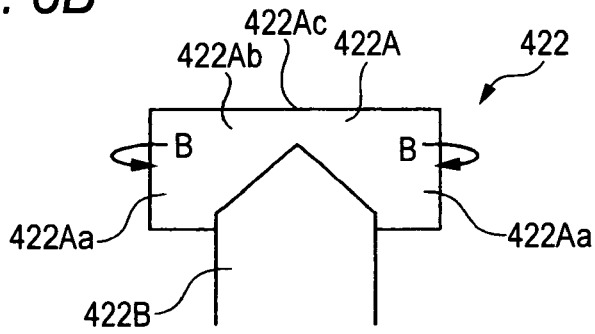

More specifically, a wiper member 421 is constituted by a wiper member 421A formed by a rubber (a wiper side portion 421Aa, a wiper base portion 421Ab and a wiping side 421Ac) and a support plate 421B for supporting the same (for example, SUS) as shown in FIG. 8A, for example. When the wiper member 421 is relatively moved in a wiping direction (an orthogonal direction to the sheet) to slide the wiping side 421Ac over a nozzle surface, both side portions of the wiper member 421A which is not supported by the support plate 421B are flexed more easily than a central part supported by the support plate 421B and are thus deformed to be bent in a B direction. As a result, a guide portion (a first portion) is formed in the same manner as in the aspect. As shown in FIG. 8B, the case of a wiper member 422 using a support plate 422B having a tip taking a sectional chevron and a wiper member 422A attached thereto (a wiper side portion 422Aa, a wiper base portion 422Ab and a wiping side 422Ac) is also the same.

Figure 8C:
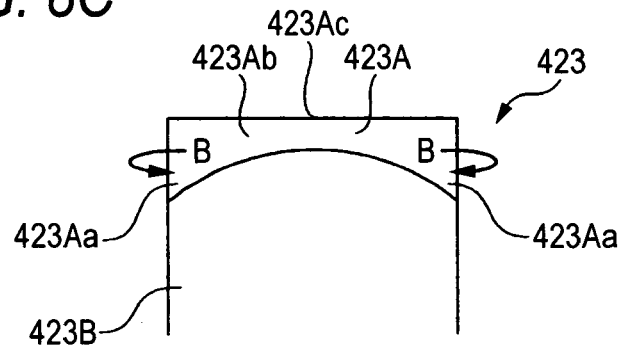
Figure 8D:
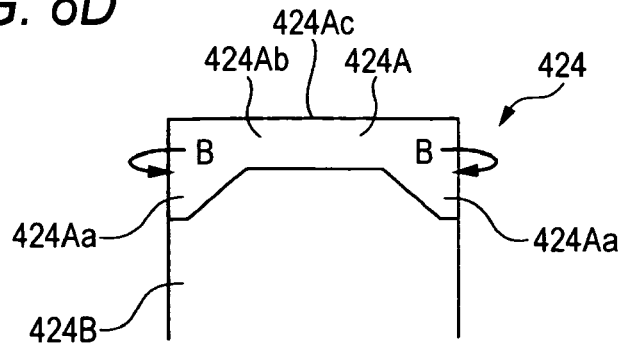

As shown in FIGS. 8A and 8B, moreover, it is not necessary to cause widths of the wiper members 421A and 422A to be greater than those of support plates 421B and 422B. Also in the case in which widths of wiper members 423A and 424A (wiper side portions 423Aa and 424Aa, wiper base portions 423Ab and 424Ab and wiping sides 423Ac and 424Ac) and those of support plates 423B and 424B are almost equal to each other as shown in FIGS. 8C and 8D, both side portions are deformed in the same manner with such a structure that thicknesses of the wiper side portions are gradually increased toward sides. Therefore, the same advantages can be obtained. The support plate 423B has a curved tip surface and the support plate 424B has a tip surface taking a trapezoidal section.

Figure 9:
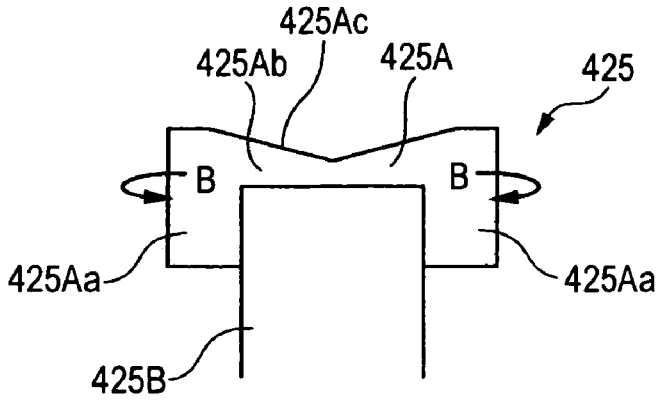
FIG. 9 is the same view as FIG. 8, illustrating a modification.

The contact surface (tip surface) of the wiper member with the nozzle surface does not need to be parallel with a nozzle surface as shown in FIGS. 8A to 8D. As shown in FIG. 9, it is also possible to employ a wiper member 425 having such a structure that a wiper member 425A having a concave portion 425Ac formed on a wiping side (a wiper side portion 425Aa and a wiper base portion 425Ab) is supported on a support plate 425B.

Figure 10:
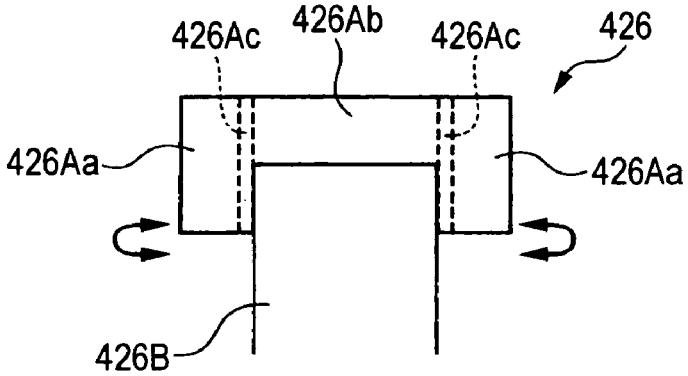
FIG. 10 is the same view as FIG. 8, illustrating a further modification.

(viii) It is also possible to employ a structure in which a linking portion of a wiper side portion to be a first portion and a wiper base portion to be a second portion is provided with hinge for permitting the wiper side portion to be inclined at a certain angle with respect to the wiper base portion corresponding to a direction of a relative movement with respect to a recording head of the wiper member. For example, if a wiper member 426 is constituted by using a wiper member 426A obtained by coupling a wiper side portion 426Aa and a wiper base portion 426Ab through a thin hinge 42GAc (hinge) to support the wiper base portion 426Ab through a support plate 426B as shown in FIG. 10, the wiper side portion 426Aa can be displaced as the first portion and can also be inclined at a certain angle with respect to the wiper base portion 426Ab (the second portion) corresponding to the direction of the relative movement of the wiper member 426 (an orthogonal direction to the sheet). Corresponding to the direction of the relative movement of the wiper member 426, the direction of the wiper side portion 426Aa with respect to the wiper base portion 426Ab is changed. Consequently, a bidirectionality can be maintained.

(ix) While the invention is applied to an ink jet recording apparatus of a piezoelectric unit type which serves to jet an ink stored in an ink groove by utilizing a piezoelectric unit (a piezo element) to be mechanically deformed by an application of a voltage in the aspect, it is also possible to apply the invention to a so-called ink jet recording apparatus of a bubble jet (registered trademark) type which serves to instantaneously give an ink heat generated by a heat generating resistor (zirconium boride), to carry out film boiling and to jet the ink by utilizing a volumetric expansion of a boiled bubble. Moreover, the invention can also be applied to an apparatus in which a nozzle of a recording head is turned in an optional direction, for example, is turned downward or inclined in addition to a nozzle opened in a horizontal direction.

(x) The invention can also be applied to the case of a line printer in which a recording head is disposed over a full width of a recording medium and is not moved. In other words, the recording head is provided for each color and a clearance is formed between the recording heads. By moving, in a direction of the nozzle train, the wiper member including the portion for guiding the foreign matter swept away in such a direction as to separate from the nozzle train, therefore, the same advantages can be expected.

Subsequently, further aspects of the invention will be described with reference to FIGS. 11 to 19B.

A twelfths aspect of the invention is directed to an ink jet recording apparatus comprising; a recording head that discharges an ink from a plurality of nozzles constituting a nozzle train to a recording medium; a cap that covers a nozzle surface of the recording head with a cap member; and a wiper that wipes the nozzle surface of the recording head with a wiper member by a relative movement of the wiper member with respect to the recording head, wherein the nozzle surface of the recording head has a retreat surface that is retreated from a nozzle region surface provided with an ink discharging port of the nozzle through a step portion, and a portion that accumulates a foreign matter is formed in the step portion positioned on a wiping start side of the wiper member.

Consequently, the portion for accumulating a foreign matter such as a deposited substance or an ink mist is formed in the step portion positioned on the wiping start side of the wiper member. Prior to an operation for wiping the nozzle region surface, therefore, a foreign matter (a deposited substance generated in a contact portion of the cap member and the nozzle surface of the recording head) caught by the wiper member is collected in the portion for accumulating a foreign matter when the wiper member wipes the retreat surface. Accordingly, the foreign matter can be prevented from being brought into the nozzle region surface together with the wiper member.

Thus, the foreign matter can be prevented from being brought into the nozzle region surface by the wiper member. Therefore, the clogging of the discharging port of the nozzle can be avoided and a stable ink discharging characteristic can be maintained for a long period of time.

A thirteenth aspect of the invention is directed to the ink jet recording apparatus, wherein the portion that accumulates a foreign matter is a wedge-shaped groove portion formed by the retreat surface and a first inclined surface provided continuously at an acute angle with respect to the retreat surface.

Consequently, the portion for accumulating a foreign matter can easily be formed as the wedge-shaped groove portion. Because of the wedge-shaped groove portion, moreover, a foreign matter mixed with a deposited substance or an ink mist is easily accumulated by a capillary action.

A fourteenth aspect of the invention is directed to the ink jet recording apparatus, wherein a second inclined surface forming an acute angle with respect to the nozzle region surface is provided continuously with the nozzle region surface at a wiping start side of the wiper member.

Thus, the foreign matter swept away by the wiper member over the retreat surface is effectively scraped from the wiper member prior to an entrance into the nozzle region surface in the acute portion formed by continuously providing the second inclined surface forming an acute angle with respect to the nozzle region surface.

A fourth aspect of the invention is directed to the ink jet recording apparatus, wherein the step portion positioned on the wiping start side of the wiper member has an upper edge portion forming substantially a straight line inclined with respect to a direction of the relative movement of the wiper member as seen in an orthogonal direction to the nozzle surface.

Consequently, the step portion positioned on the wiping start side of the wiper member has an upper edge portion formed like an inclined straight line with respect to a direction of the relative movement of the wiper member as seen in an orthogonal direction to the nozzle surface. In the wiping operation of the wiper member, therefore, a foreign matter scraped away is guided in a direction in which the inclined straight portion is extended. Thus, the foreign matter can be accumulated on one of sides of the portion for accumulating a foreign matter (either side of the recording head), which is advantageous to the avoidance of the residence of the foreign matter for a long period of time.

A sixteenth aspect of the invention is directed to the ink jet recording apparatus, wherein the first inclined surface is formed with an inclination with respect to the direction of the relative movement of the wiper member as seen in the orthogonal direction to the nozzle surface and a depth of the portion that accumulates a foreign matter is gradually increased toward a front side in a wiping direction of the wiper member.

Thus, the first inclined surface is formed with an inclination with respect to the direction of the relative movement of the wiper member as seen in the orthogonal direction to the nozzle surface and a depth of the portion for accumulating a foreign matter is gradually increased toward a front side in a wiping direction of the wiper member. Therefore, the depth of the portion for accumulating a foreign matter is gradually increased in a guiding direction so that the foreign matter is accumulated with a margin.

A seventeenth aspect of the invention is directed to the ink jet recording apparatus, wherein a third inclined surface forming a right angle or an obtuse angle with respect to the nozzle region surface is provided continuously with the nozzle region surface at a wiping end side of the wiper member.

Consequently, a third inclined surface forming a right angle or an obtuse angle with respect to the nozzle region surface is provided continuously at a wiping end side of the wiper member. Therefore, the cap member can be prevented from coming in contact with the nozzle region surface, which is advantageous to a reduction in the influence of a foreign matter such as a deposited substance generated by the contact. By forming the third inclined surface to form the obtuse angle, particularly, the wiper member is not deformed very greatly when the wiper member ends the operation for wiping the nozzle region surface and separates from the nozzle region surface. Consequently, an ink is less scattered so that an influence on a discharging port of another nozzle which is provided adjacently is reduced.

A seventh aspect of the invention is directed to the ink jet recording apparatus, further comprising a speed control unit that controls a relative moving speed of the recording head and the wiper member, the speed control unit having such a structure that the wiper member reduces the relative moving speed more greatly when the wiper member crosses the step portion than that when the wiper member wipes the nozzle region surface.

By the speed control of the wiper member, thus, the foreign matter swept away from the retreat surface by the wiper member is reasonably scraped away from the wiper member in a site of the step portion and is accumulated in the portion for accumulating a foreign matter prior to the entrance into the nozzle region surface.

An nineteenth aspect of the invention is directed to the ink jet recording apparatus, wherein the wiper member takes a shape of a plate having a flexibility and is supported in an inclination state to an opposite side of the first inclined surface.

Thus, the foreign matter swept away from the retreat surface by the wiper member is easily scraped away in the step portion, and furthermore, the wiper member is caught on the step portion so that the generation of an operating failure is avoided. In the case in which the third inclined surface is provided as in the sixth aspect of the invention, particularly, a change in a shape of the wiper member in a separation from the nozzle region surface is lessened. Thus, the scattering of an ink can be reduced extremely.

A twentieth aspect of the invention is directed to the ink jet recording apparatus, wherein the retreat surface is formed around the nozzle region surface and has such a structure that a peripheral edge portion of an opening of the cap member comes in contact therewith, and a ring-shaped groove portion in which the peripheral edge portion of the cap member is fitted is formed on the retreat surface.

Thus, the ring-shaped groove portion has the effect of trapping a foreign matter (a deposited substance generated in the contact portion of the cap member), which is advantageous in order to reduce the foreign matter to be brought into the nozzle region surface by the wiper member.

As described above, the step portion is disposed between the nozzle region surface provided with the ink discharging port of the nozzle and the retreat surface which is retreated from the nozzle region surface over the nozzle surface of the recording head, and the portion for accumulating a foreign matter is formed on the wiping start side of the wiper member in the step portion. Therefore, the foreign matter swept away from the retreat surface by the wiper member can be collected in the portion for accumulating a foreign matter and can be thus prevented from being brought into the nozzle region surface. Accordingly, the foreign substance can be prevented from entering the discharging port of the nozzle to cause clogging. Thus, it is possible to maintain a stable ink discharging characteristic for a long period of time.

Figure 11:
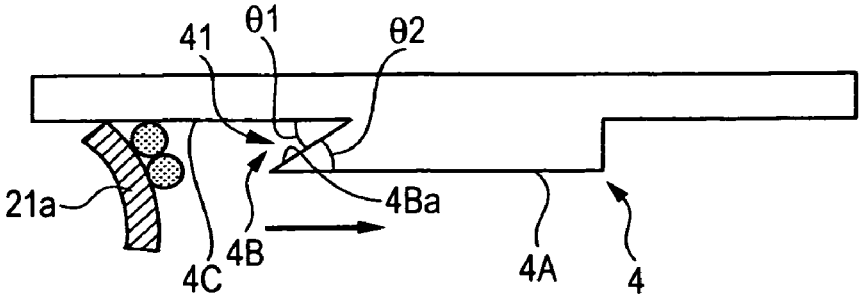
FIG. 11 is a schematic sectional view showing a recording head.
Figure 12:
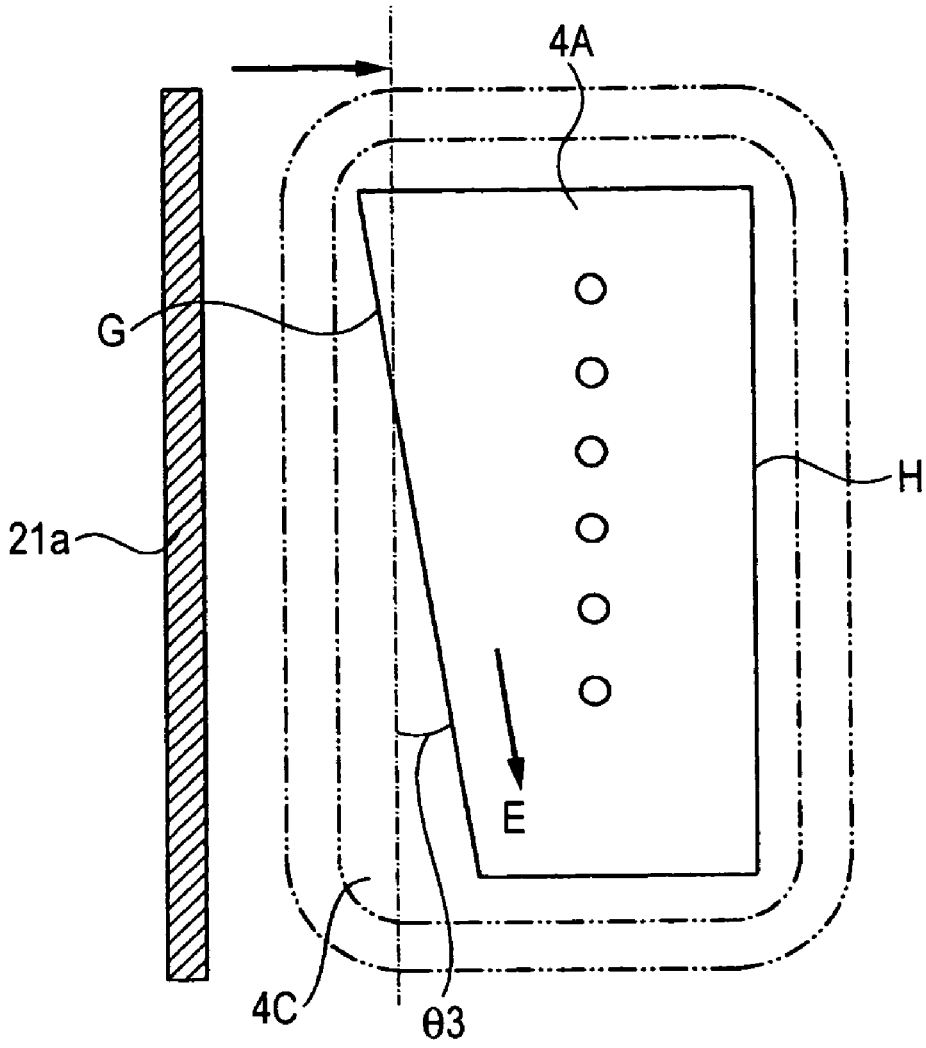
FIG. 12 is a schematic plan view showing the same.

As shown in FIG. 11, the nozzle surface of the recording head 4 has a retreat surface 4C which is retreated from a nozzle region surface 4A through a step portion 4B with respect to the nozzle region surface 4A provided with an ink discharging port of the nozzle. In other words, the nozzle surface has the nozzle region surface 4A and the retreat surface 4C which is retreated (separated) by an interval corresponding to a height of the step portion 4B. The nozzle region surface 4A is covered in a closing state by a contact of the peripheral edge portion of the opening of the sucking cap member 24 with the retreat surface 4C disposed around the nozzle region surface 4A (a region with which the peripheral edge portion of the opening of the sucking cap member 24 comes in contact is shown in a two-dotted chain line in. FIG. 12).

A portion 41 for accumulating a foreign matter such as a deposited substance or an ink mist is formed in the step portion 4B positioned on the wiping start side of the wiper member 21*a*.

The portion 41 for accumulating a foreign matter is constituted as a space portion formed by the retreat surface 4C and a first inclined surface 4Ba which is provided continuously at an acute angle (an angle θ1) with respect to the retreat surface 4C, that is, a wedge-shaped groove portion. The reason why the angle θ1 formed by the retreat surface 4C and the first inclined surface 4Ba is set to be the acute angle is that the acute angle can cause a foreign matter such as a deposited substance or an ink mist to easily enter the portion 41 for accumulating a foreign matter by a capillary action and to be collected reliably. On the other hand, if the angle θ1 is set to be the obtuse angle, there is a possibility that the foreign matter swept away might be wetted and spread again because the ink usually has a small contact angle with a material.

Moreover, the first inclined surface 4Ba also functions as a second inclined surface provided continuously with the nozzle region surface 4A of the recording head 4 and forming an acute angle (an angle θ2) with respect to the nozzle region surface 4A at the wiping start side of the wiper member 21*a*. The angle θ2 is set to be an acute angle which is smaller than 90 degrees with respect to the nozzle region surface 4A for the following reason. More specifically, if an obtuse angle is set, a deposited substance generated by the contact of the sucking cap member 24 cannot be reliably removed by the wiper member 21*a* so that the foreign matter might reach the ink discharging port of the nozzle and might enter the nozzle.

Moreover, an upper edge portion G of the step portion 4B positioned on the wiping start side of the wiper member 21*a* (a linear portion formed by crossing a wiping start side edge portion of the nozzle region surface 4A and an upper edge portion of the first inclined surface 4Ba) is formed like a straight line which is inclined by approximately an angle θ3 (=20 degrees), for example, with respect to an orthogonal direction to a (relative) moving direction (wiping direction) of the wiper member 21*a* as shown in FIG. 12 as seen in an orthogonal direction to the nozzle surface (the nozzle region surface 4A). An upper edge portion H on a wiping end side is extended in the orthogonal direction to the (relative) moving direction of the wiper member 21*a*.

By inclining the upper edge portion G, thus, it is possible to move a foreign matter (a deposited substance or an ink mist) to either side (an E direction) of the recording head 4 (the nozzle surface) and to accumulate the same therein by the wiping operation of the wiper member 21*a*. Accordingly, it is possible to prevent the residence of the foreign matter for a long period of time. In this case, the first inclined surface 4Ba is formed with an inclination to the direction of the relative movement of the wiper member 21*a* as seen in an orthogonal direction to the nozzle surface and a depth of the portion 41 for accumulating a foreign matter is gradually increased toward a front side in the direction of the relative movement of the wiper member 21*a* so that the foreign matter can easily be accumulated more easily, which is not specifically shown.

Figure 13:
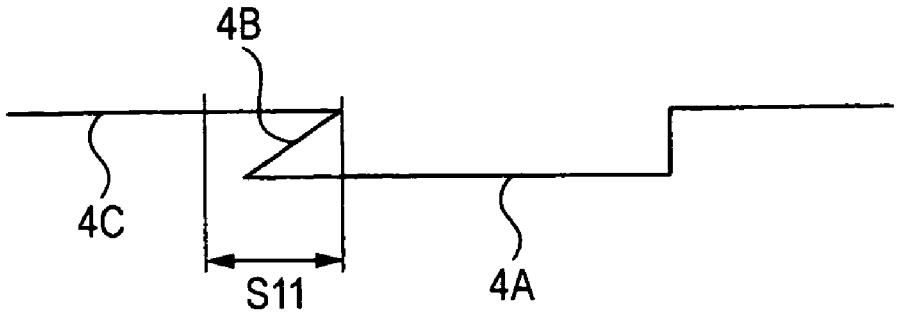
FIG. 13 is an explanatory view showing a relative moving speed of a wiper member.

The carriage motor 10 is electrically linked to speed control means which is not shown (for example, a microcomputer) and has such a structure that a relative moving speed of the recording head 4 and the wiper member 21*a* placed in a wiping position can be controlled. By the speed control means, it is possible to control the wiping speed of the wiper member to be constant or variable. In the aspect, in a region S11 in which the wiper member 21*a* passes through the vicinity of the step portion 4B as shown in FIG. 13, for example, the relative moving speed is reduced more greatly than that in the other regions, and a foreign matter (for example, a deposited substance) is scraped away in the step portion 4B so as to be easily accumulated in the portion 41 for accumulating a foreign matter.

While the aspect according to the invention has been described above, the invention is not restricted thereto but various changes can be made as will be described below.

Figure 14A:
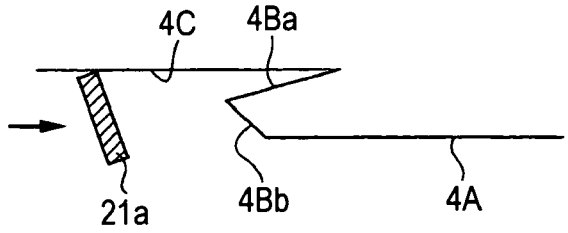
FIGS. 14A to 14E are explanatory views showing modifications of a step portion, respectively.
Figure 14B:
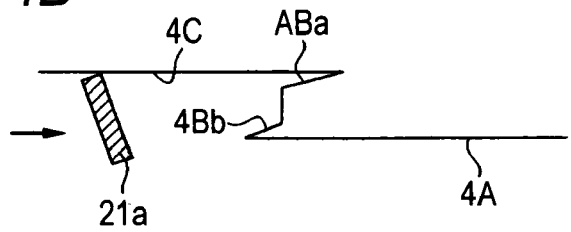
Figure 14C:
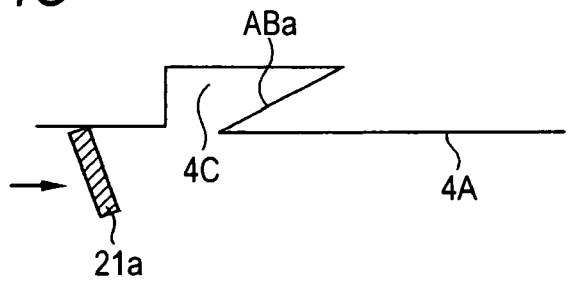
Figure 14D:
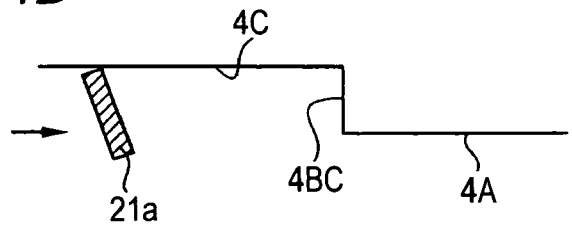
Figure 14E:
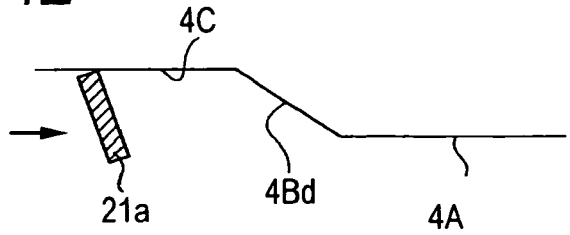

(i) The sectional shape in the vicinity of the step portion is not particularly restricted if it has the first inclined surface 4Ba and the second inclined surface 4Bb in such a manner that the portion for accumulating a foreign matter is formed together with the retreat surface 4C as shown in FIGS. 14A and 14B, for example, in addition to the foregoing. For example, it is also possible to form the groove portion 4C as shown in FIG. 14C. On the other hand, in the case in which the step portion is constituted by a surface 4Bc which is orthogonal to the retreat surface 4C as shown in FIG. 14D or a surface 4Bd forming an obtuse angle as shown in FIG. 14W, the effect of scraping the foreign matter away from the wiper member 21*a* is deteriorated, which is not preferable as the surface for constituting the step portion.

Figure 15A:
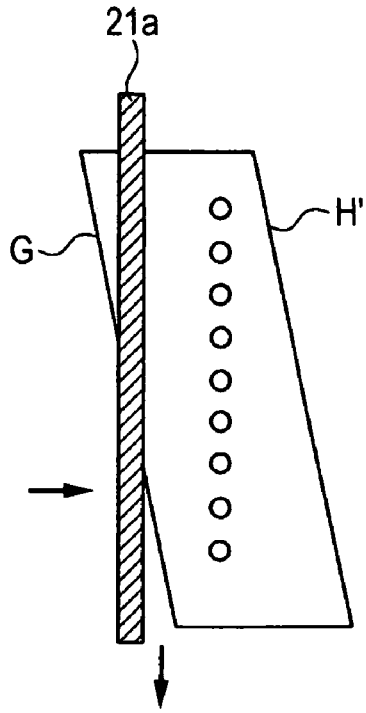
FIGS. 15A and 15B are explanatory views showing modifications of an upper edge portion of the step portion, respectively.
Figure 15B:
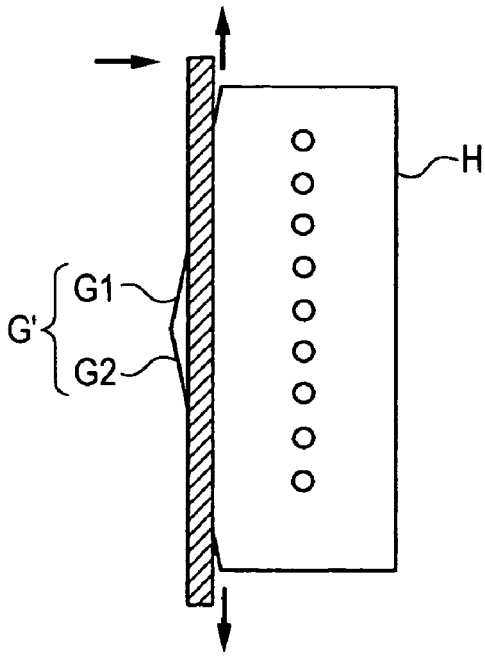

(ii) While the upper edge portion G on the nozzle wiping start side in the step portion is wholly formed with an inclination in the same direction with respect to the direction of the relative movement of the wiper member 21*a* as seen in the orthogonal direction to the nozzle surface (the nozzle region surface) in the aspect, an upper edge portion H' on the nozzle wiping end side may be parallel with the upper edge portion G as shown in FIG. 15A or an upper edge portion G' on the nozzle wiping start side can also have such a structure as to include two inclined portions G1 and G2 (or curved portions) in such a manner that a central part is protruded in the direction of the relative movement of the wiper member 21*a* with respect to side portions interposing the central part as seen in the orthogonal direction to the nozzle surface as shown in FIG. 15B.

Figure 16A:
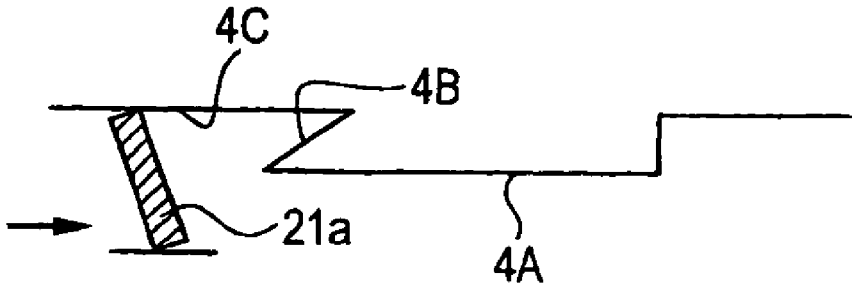
FIGS. 16A to 16C are explanatory views showing an operation of a wiper member, respectively.

(iii) While the wiper member 21*a* is supported in such a manner that the wiper wiping portion is orthogonal to the nozzle surface (the nozzle region surface 4A and the retreat surface 4C) in the aspect, it is also possible to employ a structure in which the wiper member 21*a* provided with the wiper wiping portion taking a shape of a plate having a flexibility is supported in an inclination state to an opposite side of the first inclined surface 4Ba as shown in FIG. 16A, for example. Consequently, a foreign matter can easily be pushed into the portion for accumulating a foreign matter and the wiper member 21*a* is caught in the step portion 4B with difficulty so that the generation of an operating failure can be avoided. Moreover, a stress to act on the wiper member 21*a* is also reduced. Therefore, the invention is advantageous to reduce the influence of the scattering of an ink on another nozzle which is provided adjacently.

Figure 16B:
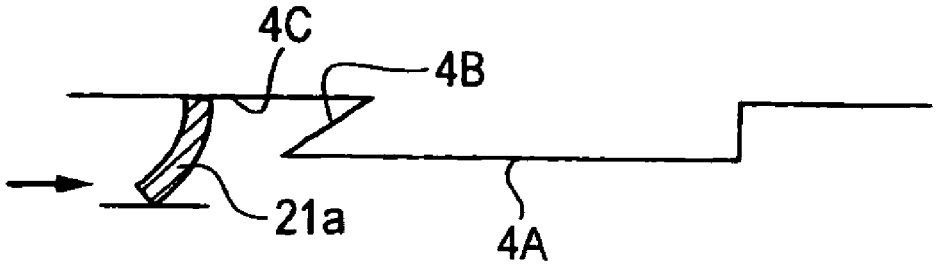
Figure 16C:
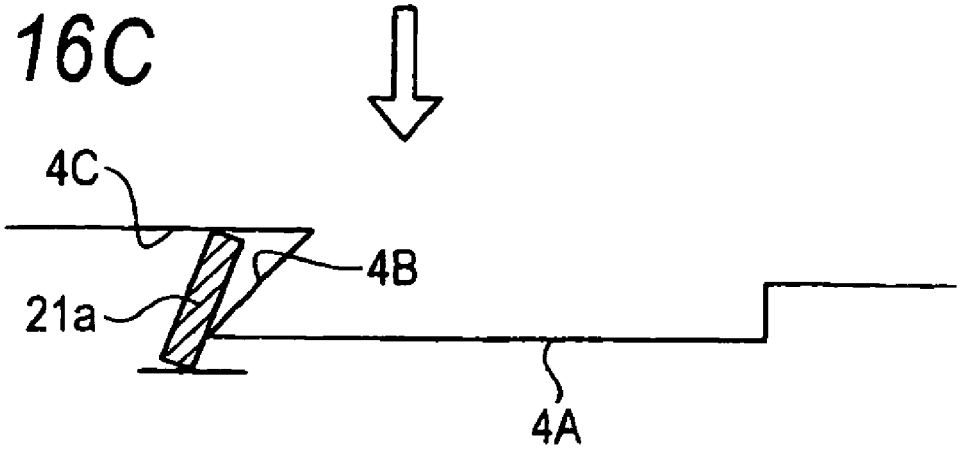

On the other hand, when the inclination is carried out in the same direction as the first inclined surface 4Ba, the effect of wiping the nozzle surface can be enhanced as shown in FIG. 16B. In case of a structure having the step portion 4B, however, there is a possibility that the wiper member 21*a* might be caught on the step portion 4B, as shown in FIG. 16C, resulting in the generation of an operating failure.

Figure 17A:
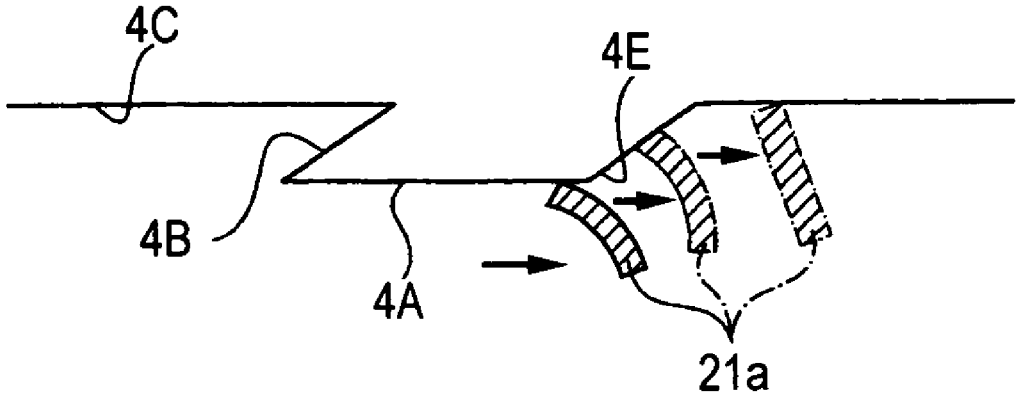
FIGS. 17A and 17B are explanatory views showing the operation of the wiper member, respectively.
Figure 17B:
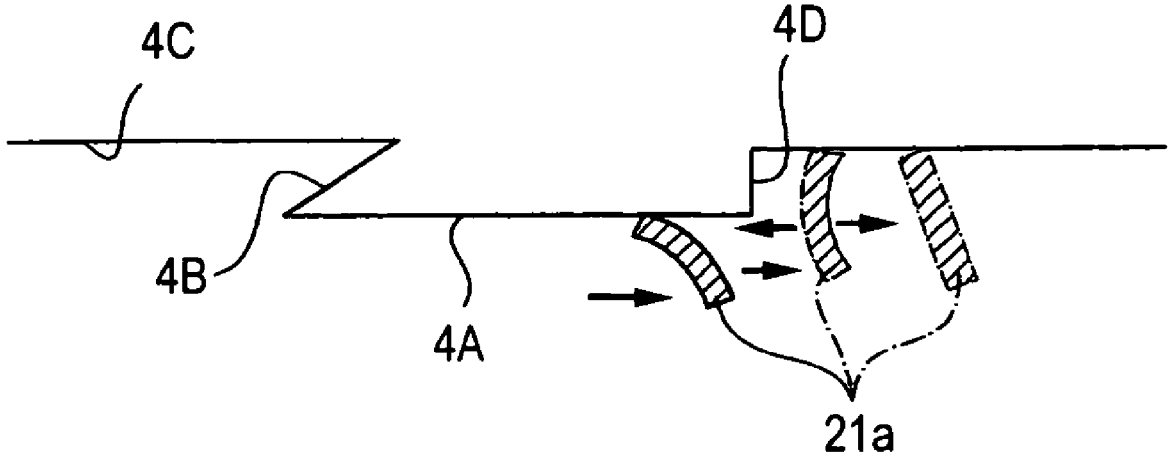

(iv) While the nozzle region surface 4A of the recording head 4 is formed by the surface 4D which is orthogonal to the nozzle surface at the wiping end side of the wiper member 21*a* in the aspect, it is also possible to employ a structure in which a third inclined surface 4E forming an obtuse angle is provided continuously with the nozzle region surface 4A as shown in FIG. 17A, for example. When the wiping end side of the wiper member 21*a* is formed by the surface 4D which is orthogonal to the nozzle surface as shown in FIG. 17B, thus, a deformation width of the wiper member at the wiping end is increased so that the scattering of an ink influences another nozzle which is provided adjacently. With the third inclined surface 4E forming an obtuse angle with respect to the nozzle region surface 4A as shown in FIG. 17A, however, the deformation width of the wiper member 21*a* is reduced. Therefore, it is possible to reduce the influence of the scattering of the ink on another nozzle which is provided adjacently.

(v) While the retreat surface 4C is a flat surface formed around the nozzle region surface 4A and the peripheral edge portion of the opening of the sucking cap member 24 comes in contact therewith in the aspect, it is possible to form, on the retreat surface 4C, a ring-shaped groove portion corresponding to the peripheral edge portion of the opening of the sucking cap member 24 and to fit the peripheral edge portion of the opening of the sucking cap member 24 in the ring-shaped groove portion. Thus, a deposited substance generated in the contact portion with the sucking cap member 24 can be accumulated in the ring-shaped groove portion. Consequently, it is possible to reduce the deposited substance to be brought to the step portion 4B side by the wiping operation of the wiper member 21*a*.

Figure 18:
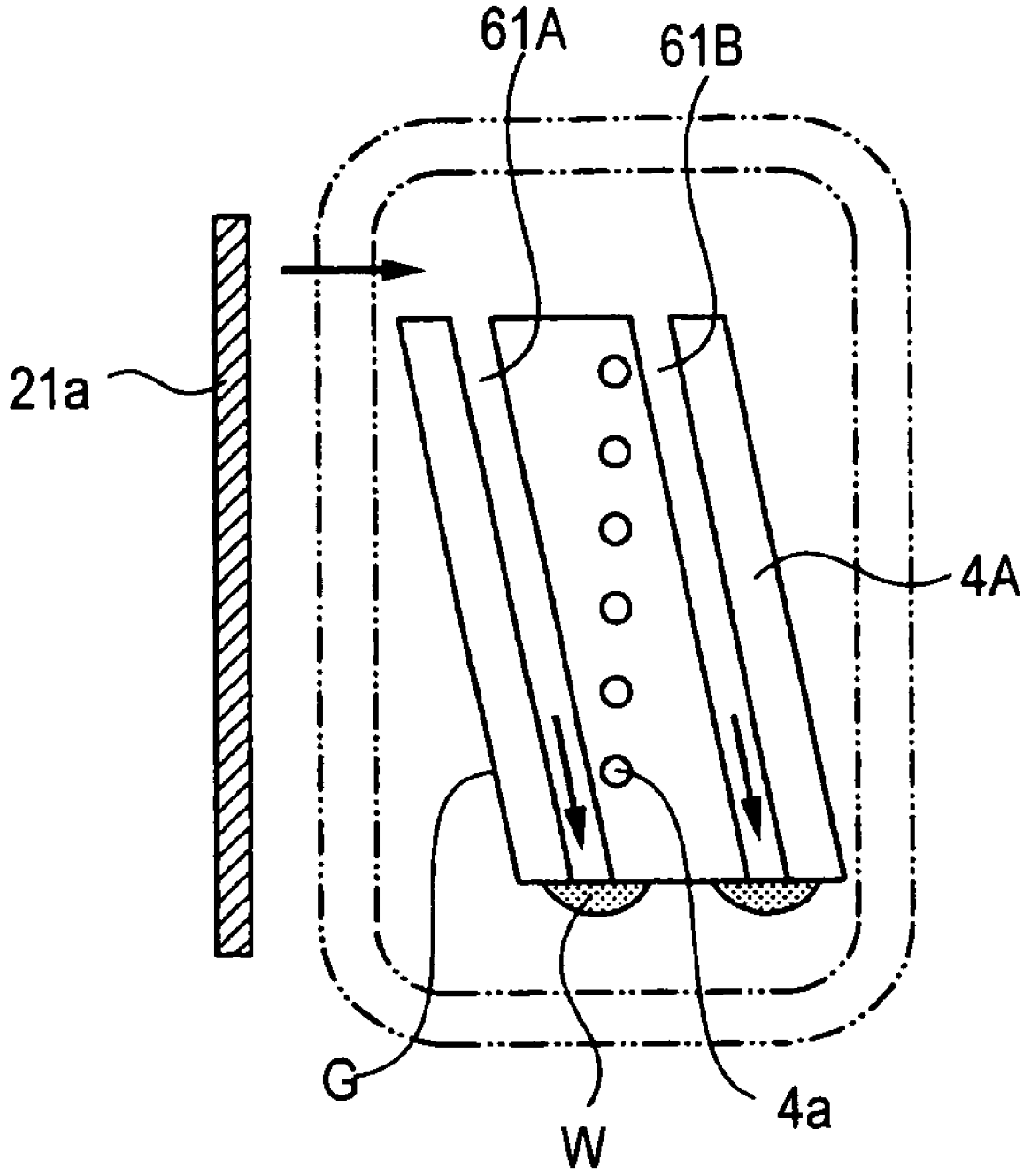
FIG. 18 is an explanatory view showing an aspect in which an inclined groove is formed on a nozzle region surface.

(vi) While the upper edge portion G of the step portion 4B is inclined so that a foreign matter is moved to either side of the recording head 4 (the nozzle surface) and is thus accumulated by the wiping operation of the wiper member 21*a* in the aspect, inclined grooves 61A and 61B extended in almost parallel with the upper edge portion G are provided on both sides of the nozzle train in the nozzle region surface 4A in such a manner that an ink W swept away by the wiper member 21*a* over the nozzle region surface 4A can also be moved to either side of the recording head along the inclined grooves 61A and 61B as shown in FIG. 18, for example. Thus, the foreign matter swept away in the step portion and accumulated in the portion for accumulating a foreign matter and the ink W swept away over the nozzle region surface 4A can also be guided to either side of the same recording head and can be accumulated therein.

Figure 19A:
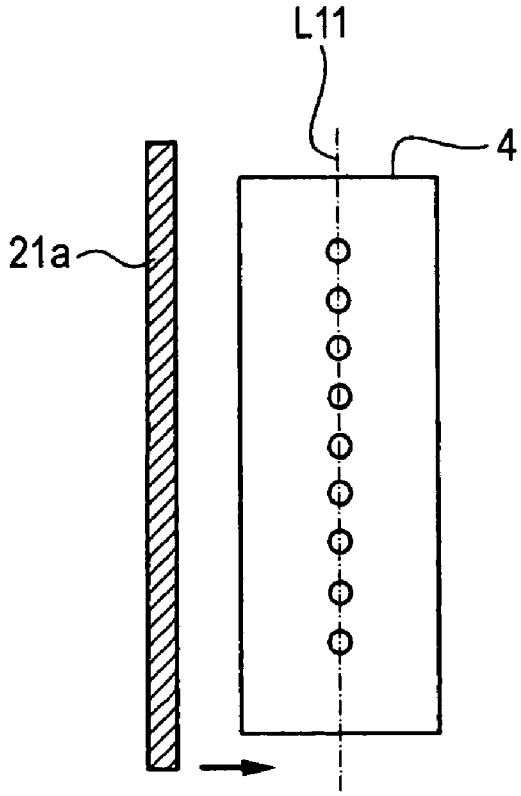
FIGS. 19A and 19B are explanatory views showing a relationship between a wiper member and a nozzle train, respectively.
Figure 19B:
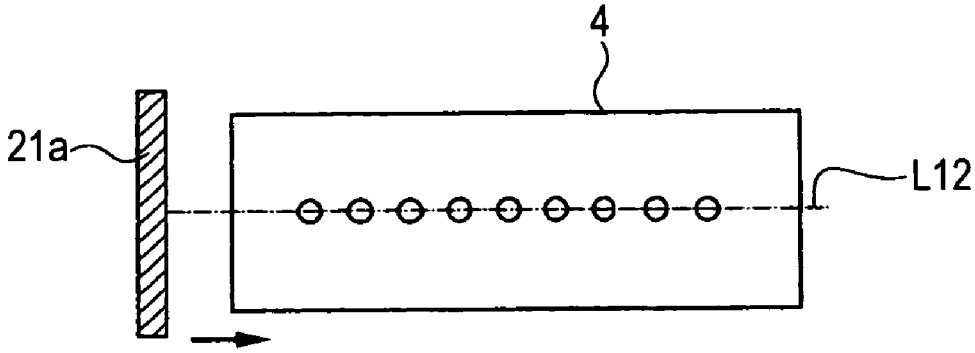

(vii) The wiping direction of the wiper member 21*a* may be a direction in which a nozzle train L11 of the recording head 4 is extended in a horizontal direction (see FIG. 19A) or a direction in which a nozzle train L12 is extended in a vertical direction (see FIG. 19B). In case of a line printer in which a recording head is disposed over a full width of a recording medium and is not moved, however, the recording head is provided for each color and a clearance is formed between the recording heads. By moving the wiper member in the direction of the nozzle train, therefore, it is possible to obtain the same advantages as those in the aspect.

(viii) In the aspect, the recording head 4 (the carriage 6) is moved with respect to the wiper member 21*a* (of the wiper device) to be moved forward and backward between a backward moving position (a standby position) and a forward moving position (a wiping operation position) to wipe the nozzle surface (the nozzle region surface 4A and the retreat surface 4C). To the contrary, it is also possible to employ a structure in which the wiper member is moved with respect to the nozzle surface by using well-known driving means for the recording head set in a stopping state and the nozzle surface is thus wiped, for example. For instance, it is also possible to employ such a structure as to fix a wiper device including an actuator for moving the wiper member forward and backward onto a moving table and to move the moving table to wipe the nozzle surface along a guide rail in a state in which the wiper member is placed in the forward moving position. In this case, the moving direction of the wiper member is not particularly restricted if a layout has no constraint, and may be a horizontal direction or a vertical direction.

(ix) While the invention is applied to an ink jet recording apparatus of a piezoelectric unit type which serves to discharge an ink stored in an ink groove by utilizing a piezoelectric unit (a piezo element) to be mechanically deformed by an application of a voltage in the aspect, it is also possible to apply the invention to a so-called ink jet recording apparatus of a bubble jet (registered trademark) type which serves to instantaneously give an ink heat generated by a heat generating resistor (zirconium boride), to carry out film boiling and to jet the ink by utilizing a volumetric expansion of a boiled bubble. Moreover, the invention can also be applied to an apparatus in which a nozzle of a recording head is turned in an optional direction, for example, is turned downward or inclined in addition to a nozzle opened in a horizontal direction.

Subsequently, further aspects of the invention will be described with reference to FIGS. 20A to 24.

JP-A-9-118012 discloses an ink jet recording apparatus, in which a crater portion is provided on a nozzle plate at a wiping upstream side, and ink stuck to the nozzle plate or the wiper member are once scraped away and the crater portion is covered with a cap in cleaning, and ink if removed from the nozzle plate through a suction.

In the recording apparatus disclosed in JP-A-9-118012, the crater portion is provided on the nozzle plate and the ink is simply scraped away from the wiper member by utilizing a step of the crater portion. A direction in which the ink is carried is the same as a direction of the wiping operation of the wiper member. If the scraping operation is not sufficiently carried out in the carter portion, therefore, there is a possibility that clogging might be caused in a discharging port of the nozzle, resulting in the generation of a recording failure.

Aspects of the invention provide an ink jet recording apparatus which guides ink toward an outside of a nozzle region by a wiping operation of a wiper member, thereby preventing clogging of a discharging port of a nozzle.

A twenty-first aspect of the invention is directed to an ink jet recording apparatus comprising: a recording head that discharges an ink from a plurality of nozzles to a recording medium; a cap that covers a nozzle surface of the recording head with a cap member; and a wiper that wipes the nozzle surface of the recording head with a wiper member by a relative movement of the wiper member with respect to the recording head, wherein the nozzle surface of the recording head is provided with a guide portion that guides inks swept away by the wiper member toward an outside of a nozzle region provided with the nozzles by a wiping operation of the wiper member.

Thus, the nozzle surface of the recording head is provided with a guide portion for guiding ink swept away by the wiper member toward an outside of a nozzle region provided with the nozzles by a wiping operation of the wiper member around the nozzle region. Therefore, the ink is guided toward the outside of the nozzle region by the wiping operation of the wiper member. Consequently, the ink is guided toward the outside of the nozzle region through the guide portion by the wiping operation of the wiper member. Therefore, it is possible to prevent clogging from being caused in the discharging port of the nozzle in the nozzle region, thereby maintaining a stable ink jetting characteristic for a long period of time.

A twenty-second aspect of the invention is directed to the ink jet recording apparatus, wherein the guide portion includes a plurality of guide regions inclined toward a front side in a direction of a relative movement of the wiper member as they extend toward an outside and the guide regions have a holding function of once holding the ink entering therein.

Consequently, the guide regions have a holding function of once staying the ink entering the same region therein. When the ink enter the guide region by the wiping operation of the wiper member, therefore, they do not go out of the guide region, that is, do not come into the nozzle region. Accordingly, the ink stays in the guide region and is guided toward the outside of the nozzle region through the guide region by the wiping operation of the wiper member.

A twenty-third aspect of the invention is directed to the ink jet recording apparatus, wherein the guide regions include a plurality of guide grooves.

Thus, the guide portion is constituted as a guide groove. Therefore, the stays in the guide groove and is smoothly guided to the outside of the nozzle region through the guide groove by the wiping operation of the wiper member.

A twenty-fourth aspect of the invention is directed to the ink jet recording apparatus, wherein depths of the guide grooves are gradually increased toward the outside, respectively.

Consequently, the depth of each of the guide grooves is gradually increased toward the outside. Therefore, the ink in the guide groove can easily flow toward the outside so that the guiding effect (for the ink) of the guide groove can be enhanced.

A twenty-fifth aspect of the invention is directed to the ink jet recording apparatus, wherein the guide regions are subjected to an ink repellent treatment so as to be more easily wettable than the nozzle surface.

Thus, the ink easily enters the guide region, and furthermore, are readily stayed in the guide region. Accordingly, the inks in the guide region are guided to flow to the outside of the nozzle region along the guide region by the wiping operation of the wiper member. Accordingly, it is possible to enhance the effect of guiding the inks by the wiping operation of the wiper member.

A twenty-sixth aspect of the invention is directed to the ink jet recording apparatus, wherein a trap portion capable of trapping the inks swept away by the wiper member is provided in the vicinity of an outside portion of the guide region.

Consequently, the trap portion is provided in the vicinity of the outside portion of the guide region. When the inks are guided to the outside portion of the guide region through the guide region, therefore, they are trapped by the trap portion and are thus prevented from being returned to the nozzle region.

As described above, in the invention, the nozzle surface of the recording head is provided with a guide portion for guiding inks swept away by the wiper member toward an outside of a nozzle region provided with the nozzles by a wiping operation of the wiper member around the nozzle region. In the wiping operation of the wiper member, therefore, it is possible to guide the inks toward the outside of the nozzle region by utilizing the guide portion. Accordingly, it is possible to prevent the inks from causing clogging in the discharging port of the nozzle, resulting in the generation of a recording failure. Thus, it is possible to maintain a stable ink jetting characteristic for a long period of time.

Figure 20A:
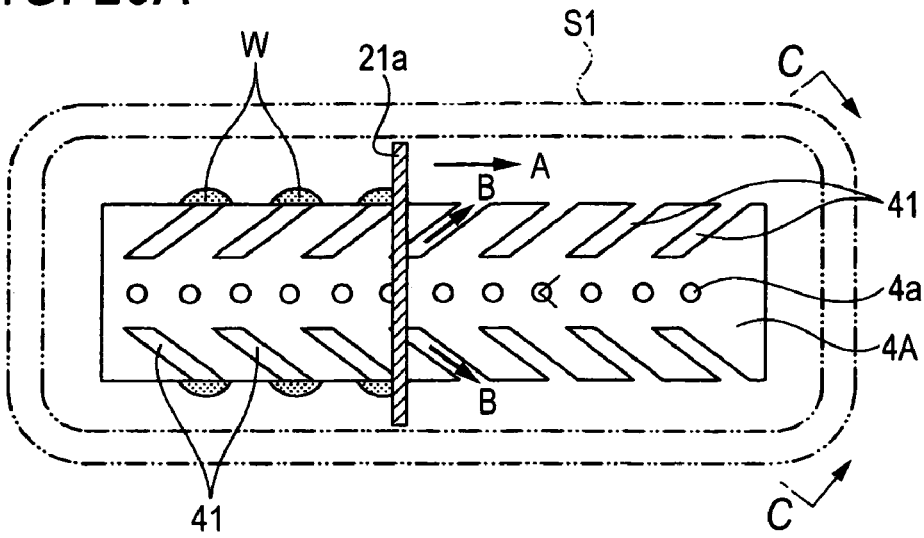
FIG. 20A is a plan view and FIG. 20B is a sectional view of a nozzle surface of a recording head.
Figure 20B:
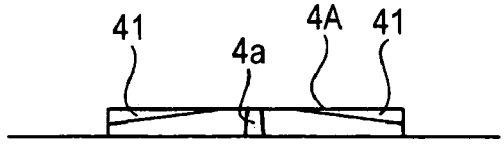

As shown in FIG. 20A, a plurality of guide grooves 41 is provided as a guide region for guiding inks (for example, paper powder, dust or a thickening ink) swept away by the wiper member 21*a* toward the outside of the nozzle region by the wiping operation of the wiper member 21*a* around the nozzle region in which a nozzle 4*a* (a nozzle train) is provided over a nozzle surface 4A of the recording head 4. The guide grooves 41 are formed with an inclination toward a front side in a direction of a relative movement of the wiper member 21*a* (a wiping direction A) toward an outside (an edge portion of the nozzle surface 4A), respectively. A depth of the guide groove 41 is gradually increased toward the outside as shown in FIG. 20B. In FIG. 20A, a portion shown in a chain line S1 indicates a contact portion of a peripheral edge portion of an opening of the cap member 24 and the nozzle surface.

With the structure, in the wiping operation of the wiper member 21, inks W swept away by the wiper member 21*a* are first brought into the guide groove 41 and the inks W thus brought in are guided toward the outside of the nozzle region through the guide groove 41, that is, in a B direction by the wiping operation of the wiper member 21. Accordingly, the inks W are not present in the nozzle region and the vicinity thereof by the wiping operation of the wiper member 21*a* but are stayed in the vicinity of a downstream end of the guide groove 41 on the outside of the nozzle region which is separated therefrom.

Thus, the inks W are guided toward the outside of the nozzle region through the guide groove 41 by the wiping operation of the wiper member 21*a*. By a synergistic effect of the wiping operation of the wiper member 21*a* and the function of a guide to the outside of the nozzle region through the guide groove 41, therefore, the wiping effect of the wiper member 21*a* can be enhanced and a stable ink jetting characteristic can be maintained for a long period of time.

While the aspect according to the invention has been described above, the invention is not restricted thereto but various changes can be made as will be described below.

(i) While the guide groove 41 is simply formed as the guide groove in the aspect, a well-known ink repellent treatment can also be carried out over the nozzle surface side in such a manner that an inner part of the guide groove is more easily wettable by the ink than the nozzle surface (the nozzle surface excluding a portion in which the guide groove is formed) in order to enhance the guiding effect of the guide groove.

Figure 21:
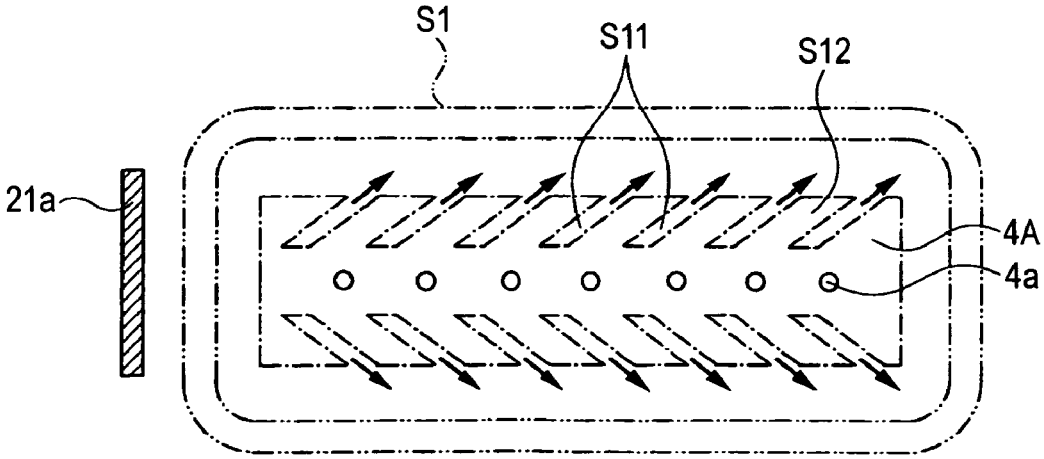
FIG. 21 is the same view as FIG. 20A, illustrating another aspect.

Moreover, the guide region does not need to be formed as the guide groove, For example, by employing a structure in which a plurality of guide regions S11 (corresponding to the guide groove 41) which is inclined to be positioned on the front side in the direction of the relative movement of the wiper member toward the outside is disposed and an ink repellent treatment is carried out over a portion of a region S12 constituting the nozzle surface 4A other than the guide region S11, and the guide region S11 thus has a holding function of once staying the ink entering the region S11 in the region S11 as shown in FIG. 21, it is also possible to obtain the same advantages as those in the case in which the guide groove 41 is provided. The guide region S11 and the region S12 are disposed on the same plane (the nozzle surface).

(ii) It is also possible to employ a structure in which a trap portion capable of trapping inks swept away by the wiper member 21*a* (for example, a felt material having a hygroscopic property) is provided in the vicinity of the outside portion of the guide region, for example, on an outside of a contact position of the cap member and the nozzle surface.

Figure 22:
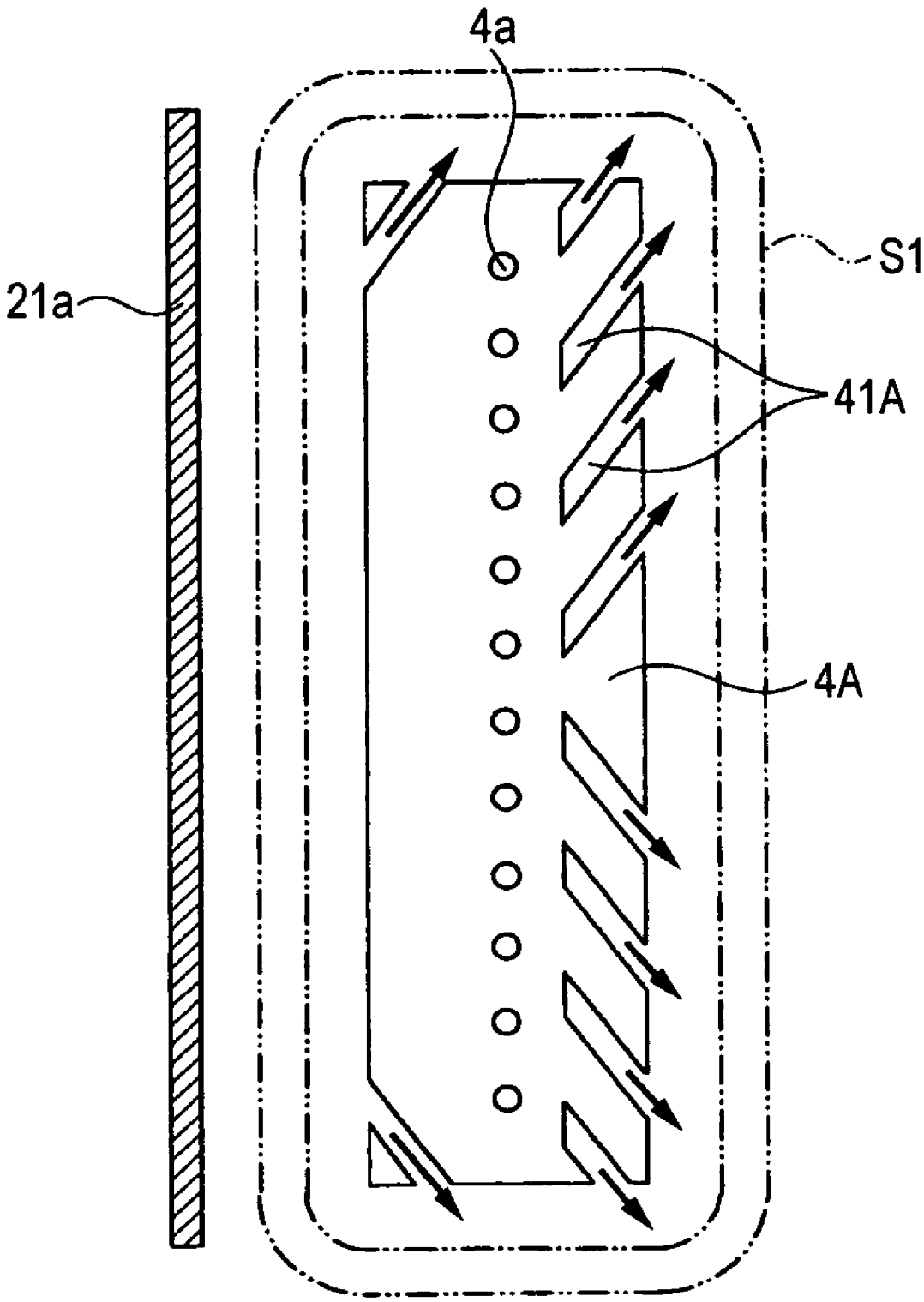
FIG. 22 is the same view as FIG. 20A, illustrating another aspect.
Figure 23:
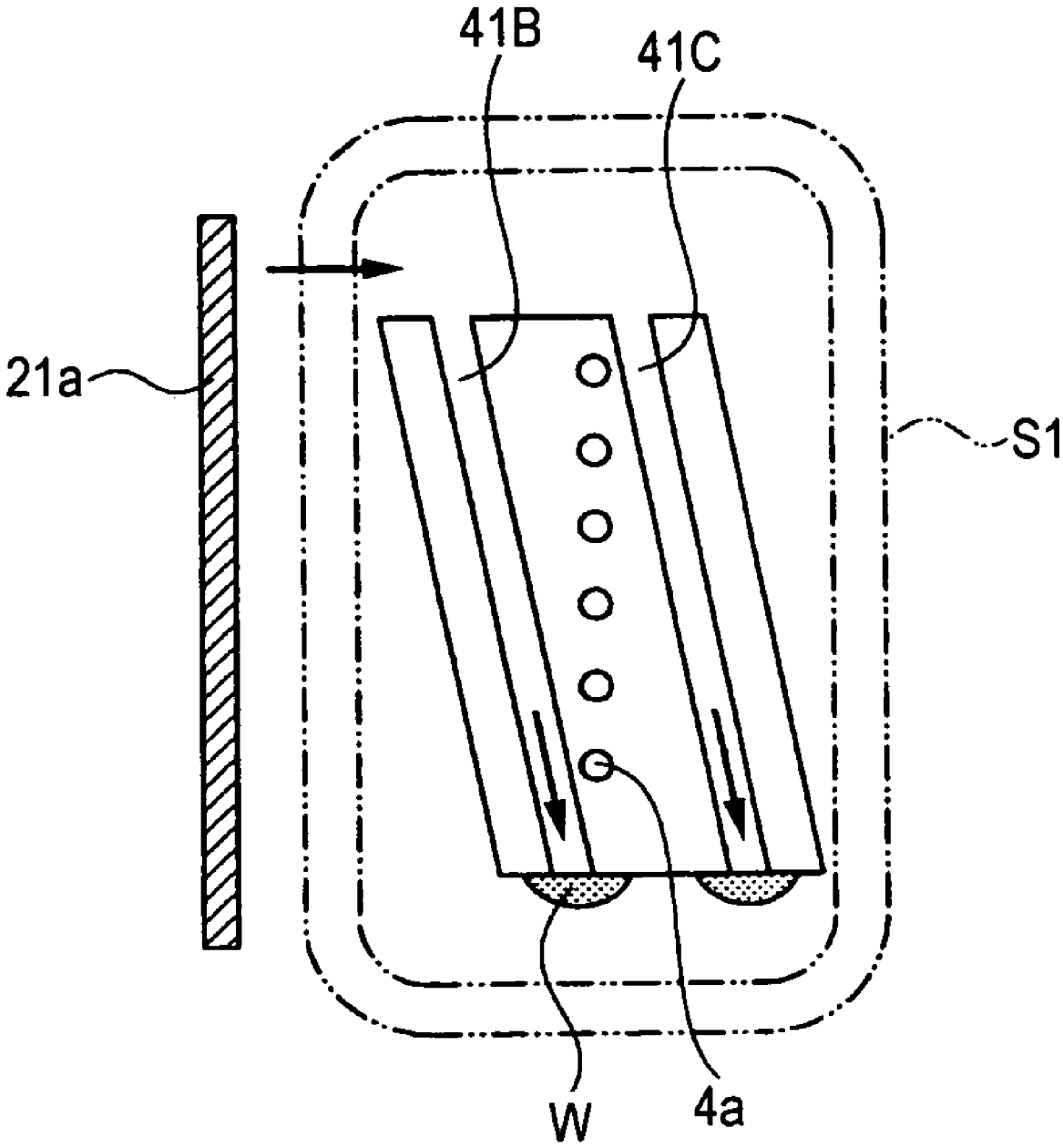
FIG. 23 is the same view as FIG. 20A, illustrating a further aspect.

(iii) In case of a recording head which is caused to carry out the wiping operation in an orthogonal direction to a direction of extension of the nozzle train by means of the wiper member, it is also possible to apply the invention by radially forming a plurality of guide grooves 41A (or guide regions) extended in a direction of an arrangement of the nozzle 4*a* at the wiping end side of the nozzle train as shown in FIG. 22 or providing guide grooves 41B and 41C inclined at a certain angle with respect to the nozzle train at the wiping start side and the wiping end side of the nozzle train as shown in FIG. 23, for example.

Figure 24:
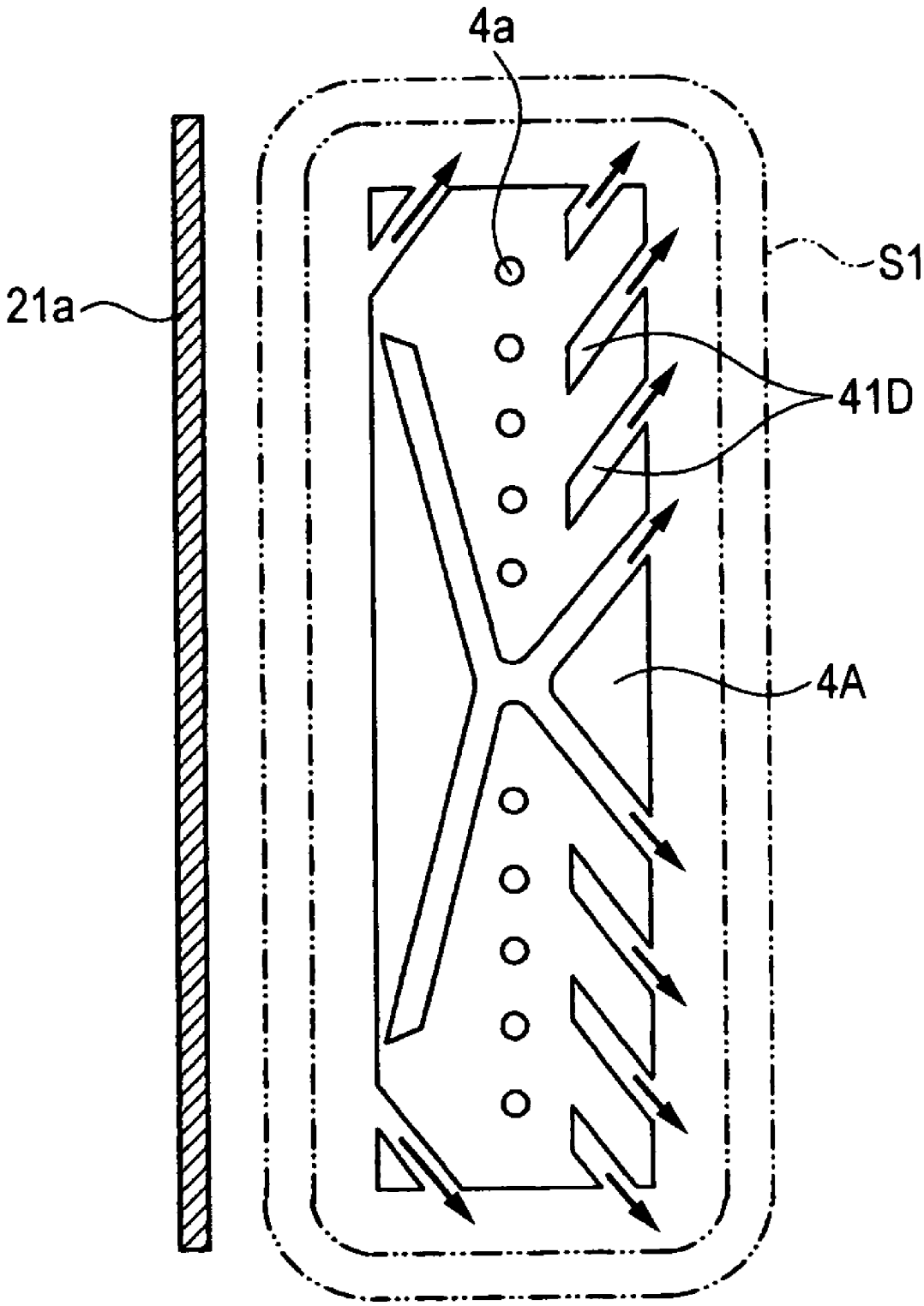
FIG. 24 is the same view as FIG. 20A, illustrating a further aspect.

(iv) As a modification of the configuration shown in FIG. 22, moreover, it is also possible to employ a structure in which the train of the nozzle 4*a* is divided into two parts and a guide groove 41D formed on the wiping end side of the nozzle train is extended from a portion between two nozzle trains to the wiping start side of the nozzle train as shown in FIG. 24. Consequently, it is also possible to guide the ink present on the wiping start side of the nozzle surface 4 to the wiping end side by keeping away from the nozzle train.

(v) In the aspect, the recording head 4 (the carriage 6) is moved with respect to the wiper member 21*a* (of the wiper device) to be moved forward and backward between a backward moving position (a standby position) and a forward moving position (a wiping operation position) to wipe the nozzle surface. To the contrary, it is also possible to employ a structure in which the wiper member is moved with respect to the nozzle surface by using well-known driving means for the recording head set in a stopping state and the nozzle surface is thus wiped, for example. For instance, it is also possible to employ such a structure as to fix a wiper device including an actuator for moving the wiper member forward and backward onto a moving table and to move the moving table to wipe the nozzle surface along a guide rail in a state in which the wiper member is placed in the forward moving position. In this case, the moving direction of the wiper member is not particularly restricted if a layout has no constraint, and may be a horizontal direction or a vertical direction.

(vi) The invention can also be applied to the case of a line printer in which a recording head is disposed over a full width of a recording medium and is not moved. In other words, the recording head is provided for each color and a clearance is formed between the recording heads. By moving, in the direction of the nozzle train, the wiper member including a portion for guiding the inks swept away in a separating direction from the nozzle train, therefore, it is also possible to expect the advantages.

(vii) While the invention is applied to an ink jet recording apparatus of a piezoelectric unit type which serves to jet an ink stored in an ink groove by utilizing a piezoelectric unit (a piezo element) to be mechanically deformed by an application of a voltage in the aspect, it is also possible to apply the invention to a so-called ink jet recording apparatus of a bubble jet (registered trademark) type which serves to instantaneously give an ink heat generated by a heat generating resistor (zirconium boride), to carry out film boiling and to jet the ink by utilizing a volumetric expansion of a boiled bubble. Moreover, the invention can also be applied to an apparatus in which a nozzle of a recording head is turned in an optional direction, for example, is turned downward or inclined in addition to a nozzle opened in a horizontal direction.

Furthermore, any of the above-described aspects shown in FIGS. 1 to 24 may be combined to configure further modifications.

What is claimed is:

1. An ink jet recording apparatus comprising:

a recording head that discharges an ink from a plurality of nozzles constituting a nozzle train to a recording medium;

a cap that covers a portion of a nozzle surface of the recording head with a hollow cap member, wherein the portion covered by the cap defines a nozzle region and the nozzle region is a region in which the plurality of nozzles are located; and a wiper that wipes the nozzle surface of the recording head with a wiper member by a relative movement of the wiper member with respect to the recording head, wherein the wiper member includes a first portion that guides a foreign matter swept away by the wiper member to an outside of the nozzle region provided with the nozzle train during at least the relative movement of the wiper member, and wherein the first portion is previously formed with a rearward inclination or curve with respect to a direction of the movement of the wiper member.

2. The ink jet recording apparatus according to claim 1, wherein the first portion is formed corresponding to a first region extended orthogonal to a direction of extension of the nozzle train in a contact region with a peripheral edge portion of an opening of the cap member in the nozzle surface of the recording head.

3. The ink jet recording apparatus according to claim 1, wherein the first portion is linked to both ends of a second portion that wipes the nozzle region.

4. The ink jet recording apparatus according to claim 3, wherein a wiping operation of the second portion in the wiper member is performed in such a manner that a portion between a second region extended in a direction of extension of the nozzle train and the nozzle region in a contact region with a peripheral edge portion of an opening of the cap member in the nozzle surface of the recording head is set to be a wiping start position and the second portion in the wiper member starts the wiping operation toward the nozzle region from the wiping start position.

5. The ink jet recording apparatus according to claim 3, wherein a wiping operation of the second portion in the wiper member is performed in such a manner that one of regions between the nozzles or the nozzle trains is set to be a wiping start position and the second portion in the wiper member carries out the wiping operation beyond one of ends of the nozzle region after the wiping operation is started, and then changes a direction of the wiping and carries out the wiping operation beyond the other end of the nozzle region.

6. The ink jet recording apparatus according to claim 3, wherein a hinge that permits the first portion to be inclined at a certain angle with respect to the second portion corresponding to a direction of the relative movement of the wiper member with respect to the recording head is provided in a linking portion of the first portion and the second portion.

7. The ink jet recording apparatus according to claim 1, wherein a plurality of nozzle trains is disposed on the nozzle surface of the recording head, and the wiper includes first and second wiper members supported movably, and the first and second wiper members are configured such that one of regions between the nozzle trains is set to be a wiping start position and they are moved in opposite directions to each other.

8. The ink jet recording apparatus according to claim 1, wherein the wiper member has two plate-shaped portions taking a dogleg-shaped section and serving as the first portion, the two plate-shaped portions are rearward inclined with respect to a direction of the movement of the wiper member.

9. The ink jet recording apparatus according to claim 1, wherein a trap portion capable of trapping a foreign matter swept away by the wiper member is provided on an outside of a contact position of the cap member and the nozzle surface.

10. An ink jet recording apparatus comprising:

a recording head that discharges an ink from a plurality of nozzles constituting a nozzle train to a recording medium;

a cap that covers a portion of a nozzle surface of the recording head with a hollow cap member, wherein the portion covered by the cap defines a nozzle region and the nozzle region is a region in which the plurality of nozzles are located; and a wiper that wipes the nozzle surface of the recording head with a wiper member by a relative movement of the wiper member with respect to the recording head, wherein the wiper member includes a first portion that guides a foreign matter swept away by the wiper member to an outside of the nozzle region provided with the nozzle train during at least the relative movement of the wiper member, and wherein the first portion is formed with a rearward inclination or curve by a friction with the nozzle surface with respect to a direction of the movement of the wiper member during the relative movement of the wiper member.

11. The ink jet recording apparatus according to claim 10, wherein the first portion is linked to both ends of a second portion that wipes the nozzle region, and wherein a hinge that permits the first portion to be inclined at a certain angle with respect to the second portion corresponding to a direction of the relative movement of the wiper member with respect to the recording head is provided in a linking portion of the first portion and the second portion.

12. An ink jet recording apparatus comprising;

a recording head that discharges an ink from a plurality of nozzles constituting a nozzle train to a recording medium;

a cap that covers a nozzle surface of the recording head with a cap member; and a wiper that wipes the nozzle surface of the recording head with a wiper member by a relative movement of the wiper member with respect to the recording head, wherein the nozzle surface of the recording head has a retreat surface that is retreated from a nozzle region surface provided with an ink discharging port of the nozzle through a step portion, which connects the nozzle surface and the retreat surface, wherein the step portion comprises an inclined surface, which is inclined to extend in a direction from a wiping start side toward a wiping end side as the inclined surface extends in a direction from a nozzle surface side toward a retreat surface, and wherein a portion that accumulates a foreign matter is formed in the step portion positioned on a wiping start side of the wiper member and is defined by at least the inclined surface.

13. The ink jet recording apparatus according to claim 12, wherein the portion that accumulates a foreign matter is a wedge-shaped groove portion formed by the retreat surface and a first inclined surface provided continuously at an acute angle with respect to the retreat surface.

14. The ink jet recording apparatus according to claim 13, wherein a second inclined surface forming an acute angle with respect to the nozzle region surface is provided continuously with the nozzle region surface at a wiping start side of the wiper member.

15. The ink jet recording apparatus according to claim 13, wherein the first inclined surface is formed with an inclination with respect to the direction of the relative movement of the wiper member as seen in the orthogonal direction to the nozzle surface and a depth of the portion that accumulates a foreign matter is gradually increased toward a front side in a wiping direction of the wiper member.

16. The ink jet recording apparatus according to claim 12, wherein the step portion positioned on the wiping start side of the wiper member has an upper edge portion forming substantially a straight line inclined with respect to a direction of the relative movement of the wiper member as seen in an orthogonal direction to the nozzle surface.

17. The ink jet recording apparatus according to claim 12, wherein a third inclined surface forming a right angle or an obtuse angle with respect to the nozzle region surface is provided continuously with the nozzle region surface at a wiping end side of the wiper member.

18. The ink jet recording apparatus according to claim 12, further comprising a speed control unit that controls a relative moving speed of the recording head and the wiper member, the speed control unit having such a structure that the wiper member reduces the relative moving speed more greatly when the wiper member crosses the step portion than that when the wiper member wipes the nozzle region surface.

19. The ink jet recording apparatus according to claim 12, wherein the wiper member takes a shape of a plate having a flexibility and is supported in an inclination state to an opposite side of the first inclined surface.

20. The ink jet recording apparatus according to claim 12, wherein the retreat surface is formed around the nozzle region surface and has such a structure that a peripheral edge portion of an opening of the cap member comes in contact therewith, and a ring-shaped groove portion in which the peripheral edge portion of the cap member is fitted is formed on the retreat surface.

21. An ink jet recording apparatus comprising:

a recording head that discharges an ink from a plurality of nozzles to a recording medium;

a cap that covers a nozzle surface of the recording head with a cap member; and a wiper that wipes the nozzle surface of the recording head with a wiper member by a relative movement of the wiper member with respect to the recording head, wherein the nozzle surface of the recording head is provided with a guide portion that guides inks swept away by the wiper member toward an outside of a nozzle region provided with the nozzles by a wiping operation of the wiper member, and wherein the guide portion extends from an inside of the nozzle region toward an outside of the nozzle region, and wherein the guide portion is inclined in a direction toward the relative movement of the wiper member.

22. The ink jet recording apparatus according to claim 21, wherein the guide portion includes a plurality of guide regions inclined toward a front side in a direction of a relative movement of the wiper member as they extend toward an outside and the guide regions have a holding function of once holding the ink entering therein.

23. The ink jet recording apparatus according to claim 22, wherein the guide regions include a plurality of guide grooves.

24. The ink jet recording apparatus according to claim 23, wherein depths of the guide grooves are gradually increased toward the outside, respectively.

25. The ink jet recording apparatus according to claim 22, wherein a region in the nozzle surface except the guide regions is subjected to an ink repellent treatment so as the guide regions are more easily wettable than the nozzle surface.

26. The ink jet recording apparatus according to claim 22, wherein a trap portion capable of trapping the inks swept away by the wiper member is provided in the vicinity of an outside portion of the guide region.

* * * * *